US012590787B1

(12) United States Patent
Woodward

(10) Patent No.: US 12,590,787 B1
(45) Date of Patent: Mar. 31, 2026

(54) MODULAR SYSTEM FOR AMMUNITION PROCESSING, STORAGE, AND TRANSPORTATION

(71) Applicant: Brian C. Woodward, Evanston, WY (US)

(72) Inventor: Brian C. Woodward, Evanston, WY (US)

( * ) Notice: Subject to any disclaimer, the term of this patent is extended or adjusted under 35 U.S.C. 154(b) by 132 days.

(21) Appl. No.: 18/471,011

(22) Filed: Sep. 20, 2023

Related U.S. Application Data

(63) Continuation-in-part of application No. 29/829,642, filed on Mar. 7, 2022, now Pat. No. Des. 1,092,051.

(60) Provisional application No. 63/409,089, filed on Sep. 22, 2022.

(51) Int. Cl.

| | |
|---|---|
| ***F42B 39/26*** | (2006.01) |
| ***B65D 1/34*** | (2006.01) |
| ***B65D 25/04*** | (2006.01) |
| ***B65D 25/28*** | (2006.01) |
| ***B65D 43/16*** | (2006.01) |
| ***B65D 51/28*** | (2006.01) |

(52) U.S. Cl.
CPC ..... *F42B 39/26* (2013.01); *B65D 1/34* (2013.01); *B65D 25/04* (2013.01); *B65D 25/2841* (2013.01); *B65D 43/16* (2013.01); *B65D 51/28* (2013.01); *B65D 2203/02* (2013.01); *B65D 2251/1016* (2013.01); *B65D 2255/00* (2013.01); *B65D 2543/00194* (2013.01)

(58) Field of Classification Search
CPC .. B65D 21/086; B65D 43/167; B65D 51/242; F42B 39/26; F42B 39/24
USPC ..... 206/3
See application file for complete search history.

(56) References Cited

U.S. PATENT DOCUMENTS

| | | | | |
|---|---|---|---|---|
| 1,213,755 A * | 1/1917 | Davies | B65D 85/12 89/34 |
| 1,629,423 A * | 5/1927 | Turk | F42B 39/00 220/555 |
| 2,349,970 A | 5/1944 | Lambeek | |

(Continued)

OTHER PUBLICATIONS

Case Club x204+ 9mm Long Term Ammo Storage Case, announced Mar. 4, 2022 [online], [site visited Dec. 12, 2023], Available from internet, URL: <https://www.amazon.com/dp/B09TWV1YKF?th=1> (Year: 2022).

(Continued)

*Primary Examiner* — Ernesto A Grano
(74) *Attorney, Agent, or Firm* — Workman Nydegger

(57) ABSTRACT

A modular ammunition storage system comprising an insert block and a plurality of cartridge pockets formed into the insert block, such that a distal end of each cartridge pocket may be closed above the bottom surface of the insert block and a proximal end of each cartridge pocket is open at the top surface of the insert block, wherein each cartridge pocket is configured to receive and removably secure a cartridge having a particular shape and caliber. The insert block is receivable and removably securable by an ammunition box insert that surrounds the perimeter of the insert block, the ammunition box insert itself surrounding the interior perimeter of the carrying case into which the insert block and ammunition box insert are received. Different insert blocks configured to hold different caliber ammunition may be provided, and interchanged with one another in the carrying case.

21 Claims, 21 Drawing Sheets

(56) References Cited

U.S. PATENT DOCUMENTS

| | | | | | |
|---|---|---|---|---|---|
| 2,705,575 | A * | 4/1955 | Hammer | F42B 39/00 | 220/849 |
| 3,209,691 | A | 10/1965 | Herter | | |
| 3,593,873 | A * | 7/1971 | Vonk | B65D 25/06 | 220/528 |
| 3,682,597 | A | 8/1972 | Husch | | |
| 3,708,563 | A * | 1/1973 | Sells | F42B 39/26 | 264/46.7 |
| 3,757,933 | A * | 9/1973 | Banta | F42B 39/20 | 206/521 |
| 4,199,057 | A * | 4/1980 | Gruaz | F42B 39/26 | 206/523 |
| 4,266,670 | A * | 5/1981 | Mykleby | B65D 5/445 | 217/65 |
| 4,292,273 | A | 9/1981 | Butz et al. | | |
| D274,789 | S | 7/1984 | Brown et al. | | |
| 4,538,723 | A * | 9/1985 | Johnson | F42B 39/26 | 206/443 |
| 4,811,836 | A * | 3/1989 | Minneman | F42B 39/26 | 206/3 |
| 5,052,549 | A * | 10/1991 | Scharch | F42B 39/00 | 86/47 |
| D331,821 | S | 12/1992 | McDaniels, II | | |
| D359,126 | S | 6/1995 | Hovatter | | |
| 5,490,604 | A * | 2/1996 | Alexander | B65D 11/1873 | 220/676 |
| 6,347,567 | B1 * | 2/2002 | Eckstein | F42B 39/26 | 89/1.801 |
| 7,395,922 | B1 * | 7/2008 | Sinha | F42B 39/24 | 206/593 |
| 7,780,026 | B1 * | 8/2010 | Zuckerman | B65D 21/0223 | 206/508 |
| 8,569,069 | B2 | 10/2013 | Durack | | |
| D695,078 | S | 12/2013 | Hertaus | | |
| D789,750 | S | 6/2017 | Noe et al. | | |
| 9,726,468 | B2 * | 8/2017 | Boyd | F42B 33/10 | |
| D840,053 | S | 2/2019 | Kamees et al. | | |
| D854,707 | S | 7/2019 | Jakobsen et al. | | |
| D867,614 | S | 11/2019 | Jones et al. | | |
| D876,959 | S * | 3/2020 | Kedairy | D9/737 | |
| D882,818 | S | 4/2020 | Leimkuehler et al. | | |
| 10,697,746 | B2 * | 6/2020 | Lutz | F42B 39/26 | |
| D909,108 | S | 2/2021 | Shing | | |
| D918,415 | S | 5/2021 | Jones et al. | | |
| 11,976,910 | B1 * | 5/2024 | Small | F42B 39/26 | |
| 2004/0031835 | A1 * | 2/2004 | McLeod | F42B 39/26 | 224/544 |
| 2008/0053843 | A1 * | 3/2008 | Edwards | F42B 39/26 | 206/3 |
| 2011/0174639 | A1 * | 7/2011 | Sibley | F42B 39/26 | 53/472 |
| 2011/0233076 | A1 * | 9/2011 | Potterfield | B65D 21/0219 | 220/4.01 |
| 2015/0096907 | A1 * | 4/2015 | Connolly | B65B 5/08 | 206/3 |
| 2016/0116263 | A1 * | 4/2016 | Engmann | B65D 1/42 | 206/3 |
| 2016/0167841 | A1 * | 6/2016 | Blagojevic | B65D 43/0216 | 220/523 |
| 2018/0038674 | A1 * | 2/2018 | Engmann | F42B 39/26 | |
| 2024/0384974 | A1 * | 11/2024 | Segelman | B65D 25/08 | |

OTHER PUBLICATIONS

Examiner Interview Summary Record received for U.S. Appl. No. 29/829,642, mailed on Mar. 4, 2025, 1 page.

Jowe Wood Ammunition Box, announced Jan. 30, 2020 [online], [site visited Dec. 26, 2023], Available from internet, URL: <https://www.amazon.de/-/en/Ammunition-Cartridge-Shots-Various-Calibres/dp/B084CVQX67> (Year: 2020).

Lyman Custom Fit Loading Block, 615 Diameter, Orange, announced Apr. 29, 2017 [online], [site visited Dec. 26, 2023], Available from internet, URL: <https://www.amazon.com/Lyman-Custom-Loading-Block-615-Diameter/dp/B06Y2Z4BHF/> (Year: 2017).

National Metallic Hardwood Reloading Tray 50-Round, announced 2017 [online], [site visited Dec. 26, 2023], Available from internet, URL: <https://www.midwayusa.com/product/1018704924> (Year: 2017).

Non-Final Rejection received for U.S. Appl. No. 29/829,642, mailed on Mar. 4, 2025, 6 pages.

Office Action Appendix received for U.S. Appl. No. 29/829,642, mailed on Mar. 4, 2025, 12 pages.

Pucker Factor Precision Ammunition Box, announced Jul. 12, 2018 [online], [site visited Dec. 13, 2023], Available from internet, URL: <https://www.facebook.com/photo/?fbid=2096437887265364&set=pb.100063579519951.-2207520000> (Year: 2018).

Seahorse 100 Round Locking Bullet, announced Jul. 3, 2019 [online], [site visited Dec. 22, 2023], Available from internet, URL: <https://www.amazon.com/Seahorse-Protective-Equipment-Cases-56B100/dp/B07TYWQXF3> (Year: 2019).

Shanenigans Daly Ammo, announced Mar. 25, 2018 [online], [site visited Dec. 22, 2023], Available from internet, URL: <https://www.youtube.com/watch?v=pz7jwHoX37s> (Year: 2018).

Winchester—9MM Luger, 124 Gr FMJ (3 X 50), announced Jan. 26, 2022 [online], [site visited Dec. 22, 2023], Available from internet, URL: <https://www.marshallbid.com/auctions/11520/lot/20941-winchester-9mm-luger-124-gr-fmj-3-x-50> (Year: 2022).

* cited by examiner

MODULAR SYSTEM FOR AMMUNITION PROCESSING, STORAGE, AND TRANSPORTATION

CROSS-REFERENCE TO RELATED APPLICATIONS

This application claims the benefit of and priority to U.S. Provisional Patent Application Ser. No. 63/409,089 filed on Sep. 22, 2022, and entitled "MODULAR SYSTEM FOR AMMUNITION PROCESSING, STORAGE, AND TRANSPORTATION," which application is expressly incorporated herein by reference in its entirety. This application is also a continuation-in-part of United States Design patent application Ser. No. 29/829,642 filed on Mar. 7, 2022, and entitled "AMMUNITION BOX", which application is expressly incorporated herein by reference in its entirety.

BACKGROUND OF THE INVENTION

1. The Field of the Invention

The present invention generally relates to systems, methods, and devices for processing, storing, and transportation of ammunition, in particular personal firearm ammunition, e.g., for recreational shooting.

2. The Relevant Technology

There are three main categories of firearms: shotguns, rifles, and handguns. Each category of firearm uses a particular type of ammunition. Shotguns typically use shotshells such as buckshot, birdshot, or slugs as ammunition. Rifles and handguns use cartridges or rounds as ammunition. These cartridges come in a variety of different sizes and shapes depending on the firearm that they will be used with. Caliber refers to the inside diameter of the barrel of a firearm, which dictates what the diameter of the cartridge should be. Each cartridge includes a shell casing that is configured to house a bullet (i.e., the projectile that exits the barrel of the gun). There are three main types of bullets: full metal jackets, hollow points, and soft points. Full metal jackets are typically used for target shooting and competition, while hollow points and soft points are typically used for self-defense. Each type of bullet has a unique shape and can come in different calibers. Thus, there a many different combinations of caliber and bullet type that exist, each with a particular size and shape.

Ammunition is typically provided as purchased in a simple temporary storage box which stores a set of cartridges which are stacked as loose, unsecured ammunition within the temporary storage box. However, this temporary storage box is usually made out of cardboard or other similar materials which are not waterproof nor impact resistant. Because of this, ammunition is often moved to a more robust storage container but such containers may still only store ammunition as loose rounds, which contact one another during transportation, etc. Particularly for high precision ammunition, such jarring repeated contact can result in damage to cartridges stored therein. Thus, while the container itself may be more impact-resistant than the original cardboard or similar packaging, as the storage container is transported, individual rounds still contact and hit one another inside the storage container. Even if some storage containers were to provide more individualized storage sleeves, pockets, or holes for different ammunition, such individualized storage spaces would be universal in shape and size and may still allow for the cartridges to shake and rattle around inside the storage container. This is a significant concern to firearm users, particularly when dealing with high precision cartridges, as wear and tear on cartridges stored this way decreases shooting accuracy during use.

In addition to such existing problems noted above, to aid in reloading, loading and reloading trays are available in the market to organize and temporarily store cartridges in a grid format such that a user is able to easily pick up and reload a set of cartridges. However, such loading and reloading trays must be loaded using cartridges from either the temporary (e.g., cardboard) storage box or an upgraded storage container as noted above. This multi-step processing, storage, and transportation of ammunition is inefficient, cumbersome and results in significant wear and damage to cartridges before they are shot, which is a significant concern, particularly for high precision shooting.

BRIEF SUMMARY

In one aspect, the present invention relates to modular ammunition storage systems, as well as systems and methods for processing, storing, and transporting ammunition. For example, different aspects and embodiments of a modular ammunition storage system are disclosed herein.

In some aspects, the modular ammunition storage system comprises an insert block receivable into a carrying case, the insert block having a front side, back side, first lateral side, second lateral side, top surface, and bottom surface forming a main body of the insert block that has a height, a length, and a width. The insert block further comprises a plurality of cartridge pockets formed into the insert block, such that a distal end of each cartridge pocket is closed above the bottom surface of the insert block and a proximal end of each cartridge pocket is open at the top surface of the insert block. Each cartridge pocket is configured to receive and removably secure a cartridge having a particular shape and caliber. The insert block can be receivable and removably securable by an ammunition box insert which is positioned in the carrying case, around the interior perimeter thereof, so that the ammunition box insert itself extends around the perimeter of the insert block, once the block is received therein. The top surface of the insert block may be flush with the top surface of the ammunition box insert.

The insert block can be provided in a variety of shapes. For example, in some aspects, the insert block comprises a rectangular prism shape. Depending on the shape and the dimensions of the insert block, the insert block is able to hold different numbers of cartridges and/or different caliber cartridges. For example, in some aspects, the insert block is configured to store approximately 10-200 cartridges, or 25-100 cartridges, or about 50 cartridges.

In such instances, the insert block can have a height of at least 0.3 inch, at least about 1 inch, at least about 2 inches, from about 1 inch to 8 inches, or from about 2 to 6 inches; a width of at least about 4 inches, at least about 5 inches, from about 4 inches to 4 feet, or about 10 inches to 3 feet, or from about 10 inches to 2 feet; and/or a length of at least about 4 inches, at least about 5 inches, from about 4 inches to 4 feet, or about 10 inches to 3 feet, or from about 10 inches to 2 feet. Length and/or width may be less than about 4 feet, less than about 3 feet, or less than about 2 feet. Height (thickness) of the insert may be less than about 12 inches, less than about 10 inches, less than about 8 inches, or less than about 6 inches. By way of example, a relatively small size insert block may be about 4 inches×5 inches, with a thickness as noted above.

Each cartridge pocket, particularly those cartridge pockets formed in a bottom insert block of the storage system, is configured to receive and removably secure a cartridge having a particular shape and caliber. The cartridge pockets may actually be formed, using the same reamer or mandrel (or same size thereof) as used to form the rifle chamber of the firearm that the system is being used to carry ammunition for. As such, the cartridge pockets provide an exact fit to the cartridges each pocket is intended to carry. In an embodiment, a majority of the cartridge may be received within the cartridge pocket. A portion of the cartridge may extend out of the pocket, to facilitate easier gripping and removal of the cartridge. Where a lid insert block is provided, such a lid insert block may also include corresponding cartridge pockets, which cover such remaining portion of the cartridge, when the carrying case is closed.

Additionally, or alternatively, some embodiments of the modular ammunition system comprise a first insert block receivable into a carrying case, the insert block having a front side, a back side, a first lateral side, a second lateral side, a top surface, and a bottom surface, collectively forming a main body of the first insert block that has a height, a length, and a width. The system also includes a second insert block that is interchangeable with the first insert block, so as to be interchangeably receivable into the carrying case, the second insert block having a front side, a back side, a first lateral side, a second lateral side, a top surface, and a bottom surface, collectively forming a main body of the second insert block that has a height, a length, and a width. Each of the insert blocks include a plurality of cartridge pockets formed therein, each cartridge pocket being open in the respective top surface of the respective insert block, such that a distal end of each cartridge pocket may be closed above the respective bottom surface of a given insert block and a proximal end of each cartridge pocket is open at the respective top surface of the respective insert block, wherein each cartridge pocket is configured to receive and removably secure at least a portion of a cartridge having a particular shape and caliber. Each insert block is selectively positionable in and removable from within the carrying case, to allow a user to select either the first insert block or the second insert block for positioning into the carrying case during use. While the first and second insert blocks may have the same dimensions, they may differ in the shape and/or caliber of the cartridge pockets provided therein, so as to allow a user to interchange one insert block for the other, when taking the carrying case to the shooting range, etc. Such a system may allow a user to safely and securely store ammunition in the plurality of insert blocks (e.g., all within a gun safe), and easily grab a desired block for placement in the carrying case when leaving for the shooting range.

Another embodiment includes a bottom insert block receivable into a bottom portion of a carrying case, the bottom insert block having a front side, a back side, a first lateral side, a second lateral side, a top surface, and a bottom surface, collectively forming a main body of the first insert block that has a height, a length, and a width. A lid insert block is receivable into a lid portion of the carrying case, the lid insert block having a front side, a back side, a first lateral side, a second lateral side, a top surface, and a bottom surface, collectively forming a main body of the lid insert block that has a height, a length, and a width. Each of the bottom and lid insert blocks include a plurality of cartridge pockets formed therein, each cartridge pocket of the bottom insert block being open in the top surface of the bottom insert block, such that a distal end of each cartridge pocket of the bottom insert block may be closed above the bottom surface of the bottom insert block and a proximal end of each cartridge pocket in the bottom insert block is open at the respective top surface of the bottom insert block, wherein each cartridge pocket of the bottom insert block is configured to receive and removably secure at least a portion of a cartridge having a particular shape and caliber, wherein each cartridge pocket of the lid insert block being open in the bottom surface of the lid insert block, such that a distal end of each cartridge pocket of the lid insert block may be closed above the top surface of the lid insert block and a proximal end of each cartridge pocket in the lid insert block is open at the respective bottom surface of the lid insert block, wherein each cartridge pocket of the lid insert block is configured to receive and removably secure at least a portion of a cartridge having a particular shape and caliber. In use, a given cartridge is received into cartridge pockets of both the bottom insert block and the lid insert block, when the carrying case is closed, and when the carrying case is opened, a base portion of the given cartridge is uncovered, no longer received into the corresponding cartridge pocket of the lid insert block, but a remaining portion of the given cartridge is still received in the cartridge pocket of the bottom insert block The bottom insert block is receivable and removably securable within a bottom ammunition box insert within a bottom portion of the carrying case, the bottom ammunition box insert surrounding a perimeter of the bottom insert block. Similarly, the lid insert block is receivable and removably securable within a lid ammunition box insert disposed in a lid portion of the carrying case, such that the lid ammunition box insert surrounds a perimeter of the lid insert block.

Additionally, or alternatively, some disclosed embodiments are directed to a modular ammunition storage system which comprises an outer carrying case, a bottom ammunition box insert, lid ammunition box insert, and plurality of cartridge pockets. The outer carrying case comprises a bottom portion and a lid portion. The bottom portion is connected to the lid portion along a first side of the bottom portion and a first side of the lid portion such that the bottom portion and lid portion are closeable to form a hollow cavity inside the outer carrying case.

The bottom ammunition box insert disposed in the bottom portion of the outer carrying case is disposed around a perimeter, in the bottom portion of the outer carrying case, and comprises a bottom cavity for receipt of the bottom insert block. Similarly, the lid ammunition box insert disposed in the lid portion of the outer carrying case is also positioned around the inside perimeter of the lid portion of the carrying case, and also includes an interior lid cavity, for receipt of the lid insert block.

A plurality of cartridge pockets are formed within the bottom insert block, such that a distal end of each cartridge pocket may be closed above the bottom surface of the insert block and a proximal end of each cartridge pocket is open at the top surface of the bottom insert block. While the distal end of the cartridge pocket may be closed in an embodiment, in another embodiment, it may be open (i.e., a hole through the entire thickness of the insert block). Each cartridge pocket is configured to receive and removably secure a cartridge having a particular shape and caliber. By implementing the disclosed embodiments in this manner, the bottom insert block is receivable and removably securable by the bottom ammunition box insert, such that an outer surface of the bottom insert block is flush with an inner surface of the cavity of the bottom ammunition box insert.

The ammunition box insert surrounds an outer perimeter of the insert block, which is received therein.

In some embodiments, the outer carrying case further comprises a locking mechanism configured to lock the bottom portion and lid portion together and/or the outer carrying case further comprises a carrying handle. Additionally, or alternatively, the outer case and/or the insert block further comprises a label indicating a caliber of ammunition for which the modular ammunition storage system or insert block is configured.

In some embodiments, the storage system further comprises a lid insert block having a front side, a back side, a first lateral side, a second lateral side, a top surface, and a bottom surface forming a main body of the lid insert block, such that the lid insert block has a height, a length, and a width. The length and width of the insert blocks (bottom and lid) may be identical. The lid ammunition box insert which surrounds the lid insert block includes a cavity configured to receive and removably secure the lid insert block.

The cartridge pockets can include bottom cartridge pockets formed in the bottom insert block and lid cartridge pockets formed in the lid insert block. Each bottom cartridge pocket corresponds to a particular lid cartridge pocket. In such aspects, each bottom cartridge pocket can be configured to removably secure a majority portion of a cartridge and each lid cartridge pocket can be configured to removably secure a minority portion of a cartridge (e.g., a base thereof, where the cartridges are inserted pointed end down, towards the distal end of the pockets in the bottom insert block).

These and other advantages and features of the present invention will become more fully apparent from the following description and appended claims or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
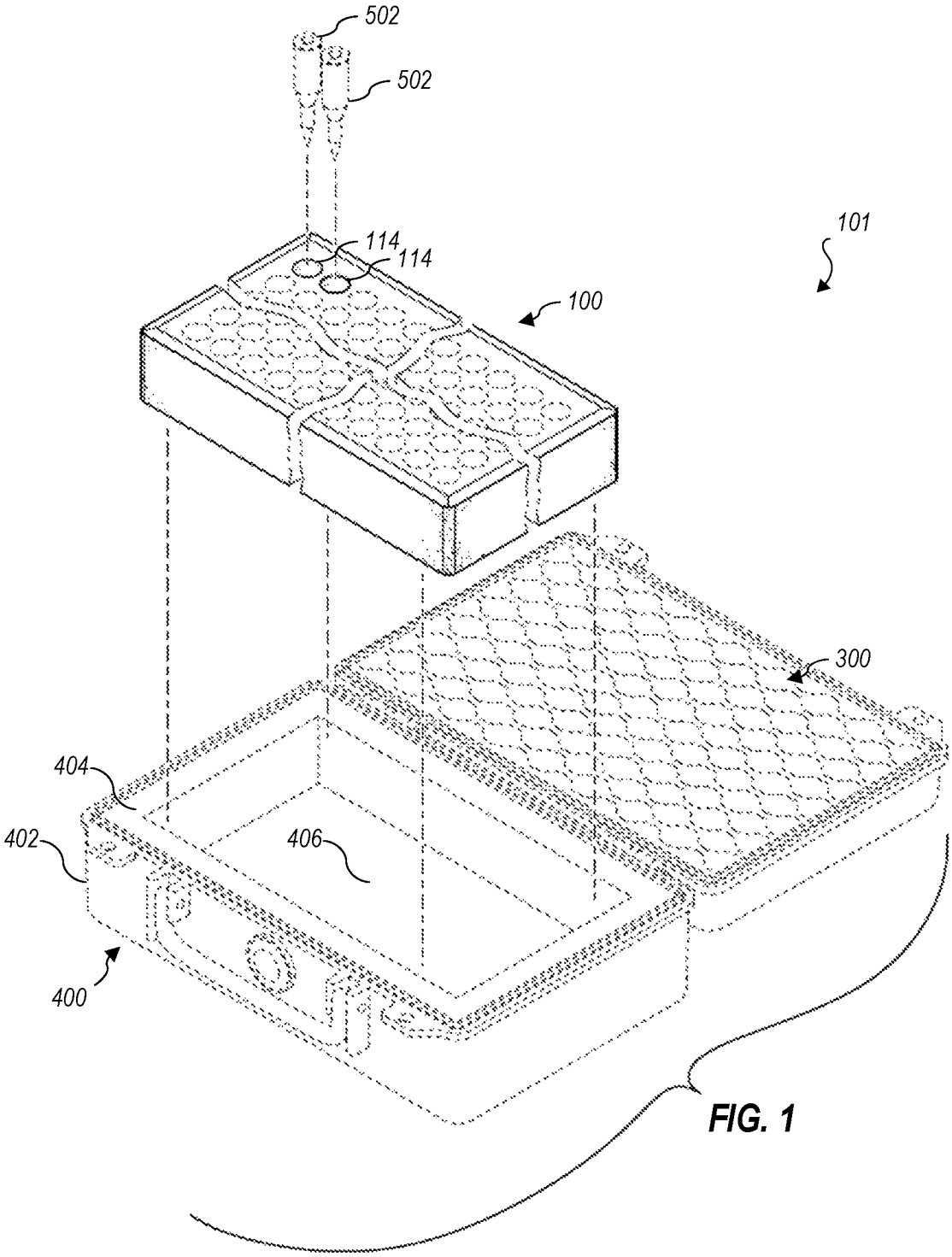
FIG. 1 is a top isometric exploded view of an ammunition box carrying case including an insert block according to the present invention.

The present invention relates to a modular system for processing, storing, and transporting ammunition. Attention will first be directed to FIG. 1, which is a top isometric exploded view of an ammunition box carrying case including an insert block according to the present invention. Ammunition box carrying case 101 is illustrated in FIG. 1 having an insert block 100 which is configured to be housed inside a bottom portion 401A of an outer case 400 and a top insert 300 which is configured to be housed inside an upper lid portion 401B of the outer case 400. The insert block 100 includes a plurality of cartridge pockets (e.g., cartridge pockets 114). Each cartridge pocket is configured to receive and removably secure a cartridge (e.g., cartridges 502).

The outer case 400 (e.g., a "Pelican" type case) comprises an outer shell 402 which forms an outer surface of the entire outer case 400, including the bottom portion 401A and the upper lid portion 401B of the outer case 400. The bottom portion 401A further comprises a bottom interior perimeter insert 404 which has a central cavity 406 configured to receive and removably secure the insert block 100 (e.g., through a simple friction fit). It should be appreciated that the cavity 406 is configurable according to different heights, widths, and lengths in order to receive different sizes of the insert block 100. Furthermore, while FIG. 1 is shown having a rectangular insert block and thus a rectangular cavity, it should be appreciated that the insert block 100 and corresponding cavity 406 may comprise any number of shapes, including rectangular, square, circular, oval, star-shaped, etc. The outer case 400 comprises an outer shell 402 which is configured to be scalable and waterproof. This outer case 400 protects the cartridges from dust and moisture, while providing a hard outer surface which also protects the insert block 100, which may be formed from a closed cell or similar foam material, from wear and tear. It will be appreciated that other materials could also be used to form insert block 100, including, but not limited to aluminum, plastic, wood, composite, or combinations thereof.

Figure 2:
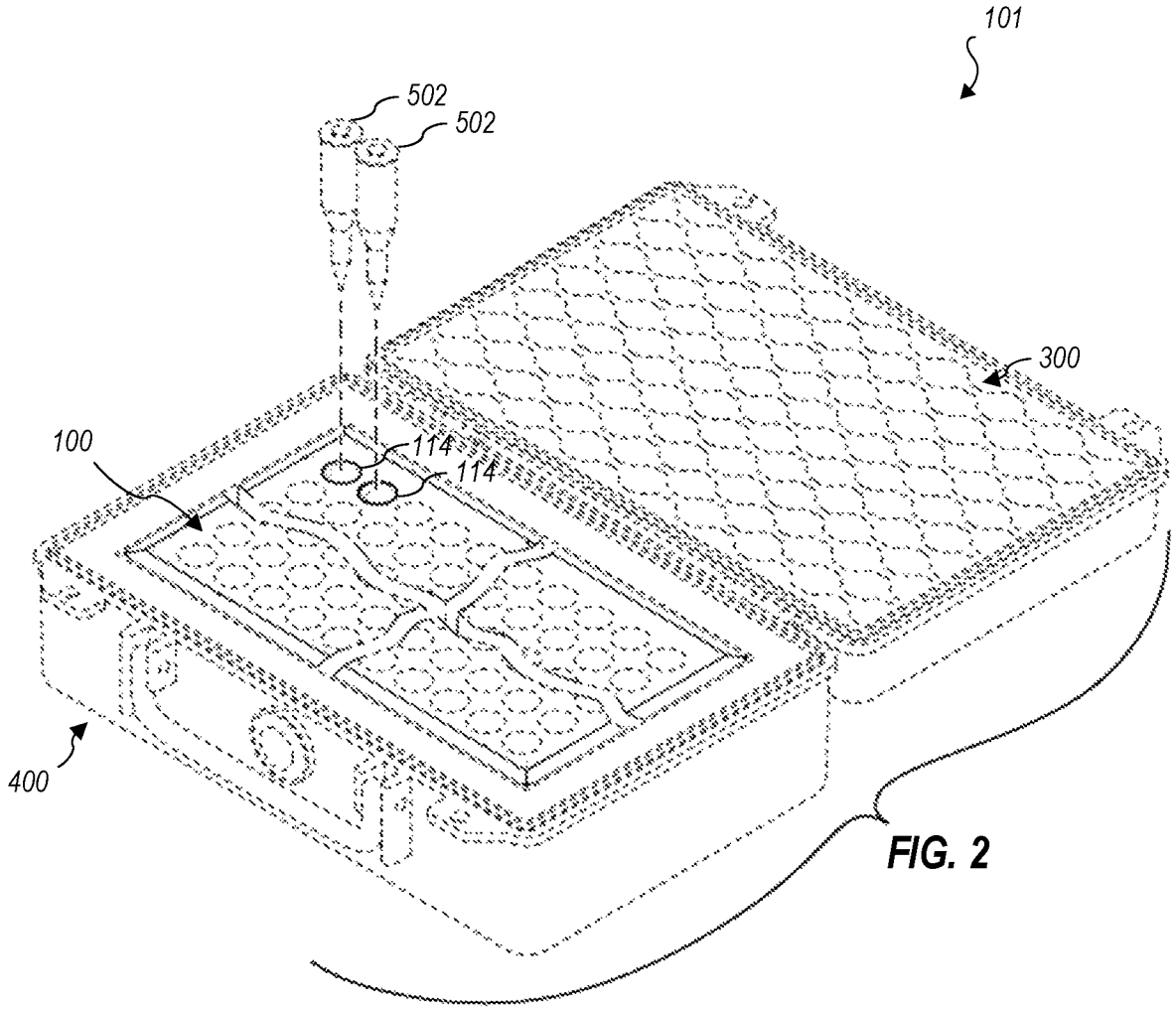
FIG. 2 is a top isometric partially exploded view of the ammunition box carrying case of FIG. 1.

Attention will now be directed to FIG. 2, which is a top isometric partially exploded view of the ammunition box carrying case of FIG. 1. The ammunition box 101 is shown with similar components as FIG. 1, now having the insert block 100 being fitted inside the cavity 406. The outer surfaces of the insert block 100 are flush with the inner surfaces of the cavity 406 such that the insert block is tightly fit inside the cavity 406. This ensures that the insert block 100 does not move around inside the outer case 400, thus decreasing any potential unwanted impact to the cartridges being stored inside the insert block 100.

Figure 3:
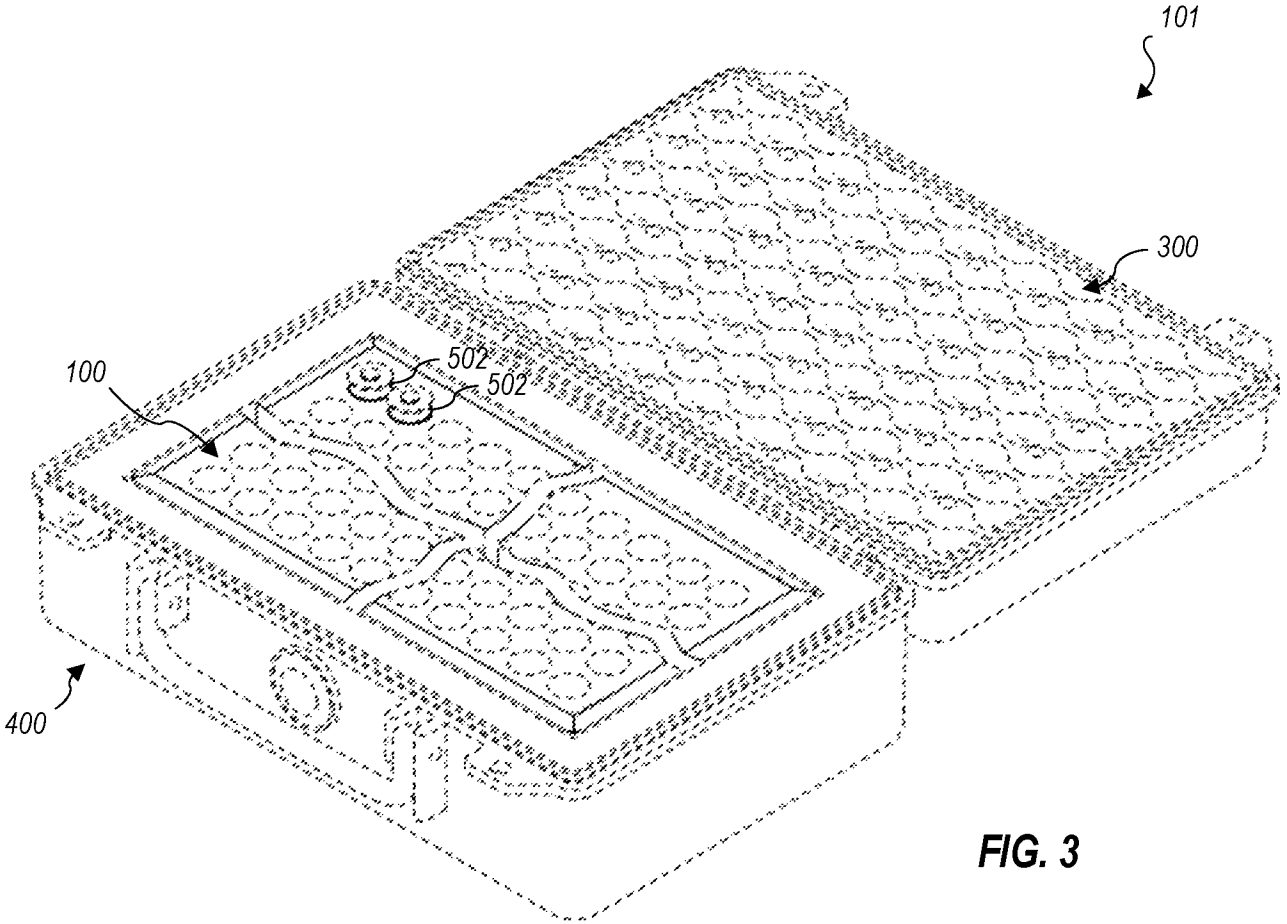
FIG. 3 is a top isometric unexploded view of the ammunition box carrying case of FIG. 1.

Attention will now be directed to FIG. 3, which is a top isometric unexploded view of the ammunition box of FIG. 1. FIG. 3 is shown having similar components to FIGS. 1-2, now having cartridges 502 removably secured within their respective cartridge pockets 114. Each cartridge pocket 114 is configured to receive and removably secure a single cartridge, such that each cartridge is cradled, supported, and protected during storage and transportation of the ammunition box carrying case. The cartridge pockets are configured to hold the cartridges such that the outer surface(s) of the cartridges are flush with the inner surface(s) of the cartridge pocket in order to minimize movement of the cartridge within the cartridge pocket, and subsequently within the ammunition box carrying case 101. This helps to protect the cartridges 502 from unwanted impact or wear and tear before being loaded into a firearm. This helps to increase the accuracy of the trajectory of each cartridge during the aiming and firing of the firearm, as the high precision tolerances of each cartridge are not compromised, due to bumping, scraping, and other unwanted contact of such cartridge with other cartridges, or damaging surfaces within the carrying case.

Figure 4:
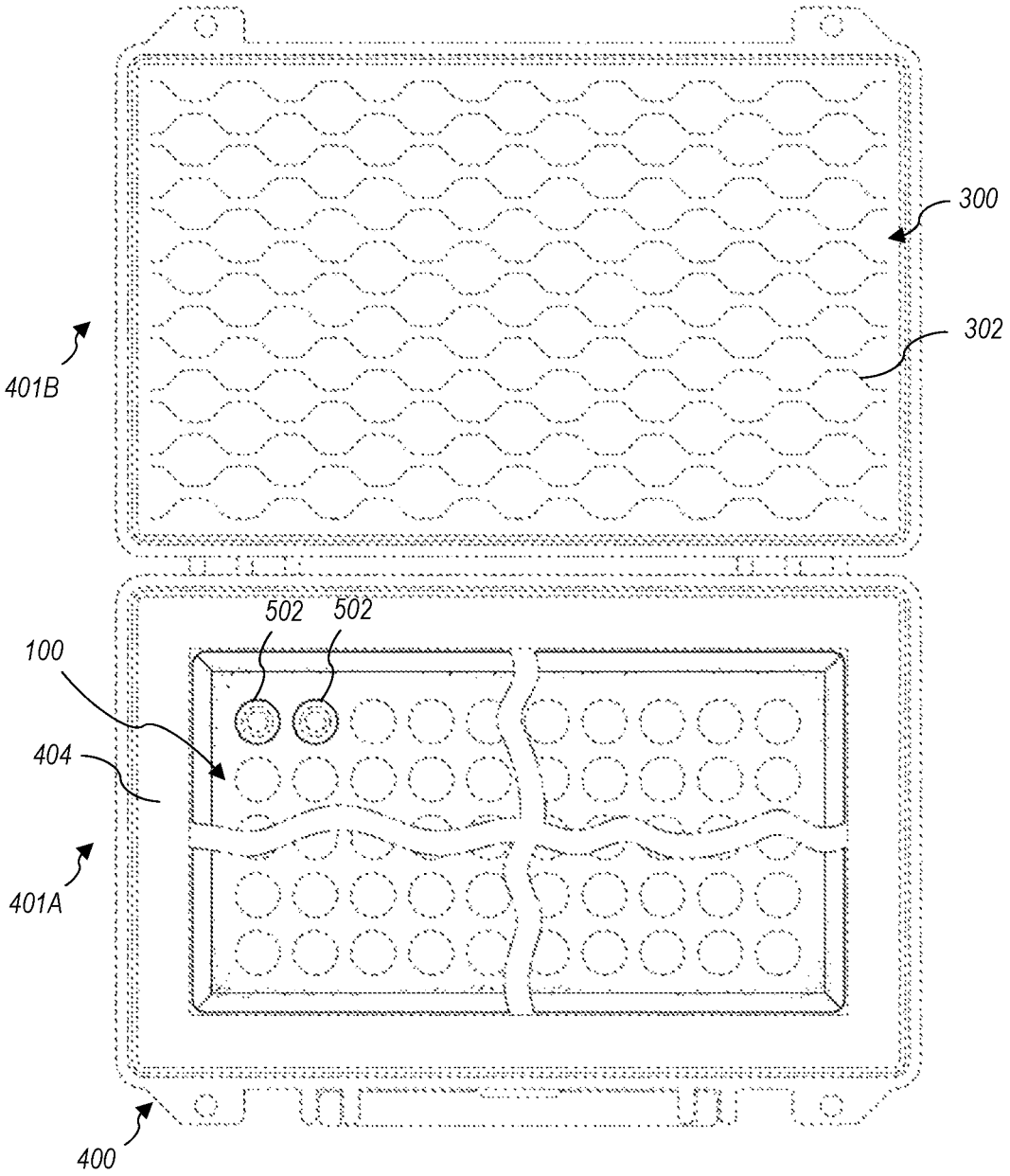
FIG. 4 is a top view of the opened ammunition box carrying case of FIG. 1.

Attention will now be directed to FIG. 4, which is a top view of the ammunition box of FIG. 1. FIG. 4 is shown having similar components as FIGS. 1-3, wherein the ammunition box 101 is shown storing a plurality of cartridges 502 inside cartridge pockets 114. The ammunition box carrying case 101 is shown in a fully open configuration, wherein the bottom portion 401A and upper lid portion 401B are both laid flat on a horizontal surface (e.g., table or countertop). The upper lid portion 401B houses the top or lid insert 300. The top or lid insert 300 may comprise a soft, shock absorptive material (e.g., foam), just as the bottom insert block. In FIG. 4, top or lid insert 300 is shown having an egg crate pattern 302. However, it should be appreciated that top insert 300 may comprise any pattern (or no pattern) which is configured to provide support and protection to cartridges 502 housed in the insert block 100. The exposed surface of the top or lid insert 300 (e.g., the surface depicted in FIG. 4) is configured to contact the portions of the cartridges housed in the top portion of insert block 100 such that the cartridges will not slip out of place, even when the ammunition box carrying case 101 is held sideways or upside-down.

Figure 5:
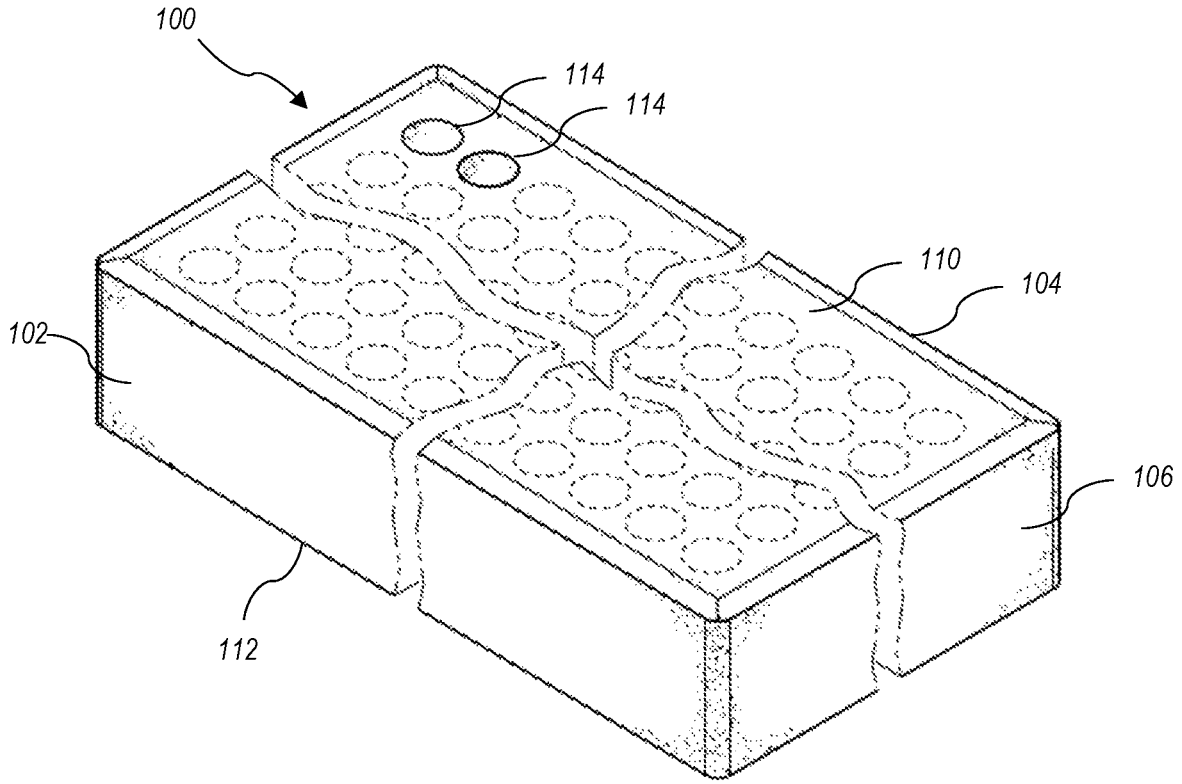
FIG. 5 is a top isometric view of the insert block of the ammunition box carrying case of FIG. 1.

Attention will now be directed to FIG. 5, which is a top isometric view of the insert block 100 of the ammunition box carrying case of FIG. 1. As shown in FIG. 5, insert block 100 is illustrated having a front side 102, a back side 104, a first lateral side 106, a second lateral side 108, a top 110, and a bottom 112. The front side 102 opposes the back side 104, the first lateral side 106 opposes the second lateral side 108, and the top 110 opposes the bottom 112. The insert block 100 is shown having a plurality of cartridge pockets 114. In FIG. 5, the cartridge pockets are shown having a circular opening at the top 110 of the insert block 100. It should be appreciated that the opening may comprise any shape that corresponds to the cartridge held therein, such that a corresponding portion of the cartridge being stored is in contact with the inner surface of the cartridge pocket.

Here, the cartridge pockets are configured to receive cylindrical cartridges (e.g., a circular opening for a circular circumference of the cartridge). Additionally, the cartridge pockets 114 are shown being disposed in a grid pattern. However, it should be appreciated that the cartridge pockets are configurable in any pattern. Here, the insert block 100 is configured to hold approximately fifty cartridges. It should be appreciated that the insert block 100 can be configured to hold different numbers of cartridges based on the dimensions of the insert block and the caliber of the cartridges which are to be stored inside the insert block 100. In some embodiments, the insert block 100 is configured to hold at least a magazine's worth of cartridges for a particular firearm. Additionally, or alternatively, the insert block 100 is configured to hold less or more than a magazine's worth of cartridges. By way of example, the insert block 100 can be configured to hold from 10 to 200 cartridges, or from 25 to 150 cartridges, or from 50 to 100 cartridges, or approximately 100 cartridges.

Figure 6:
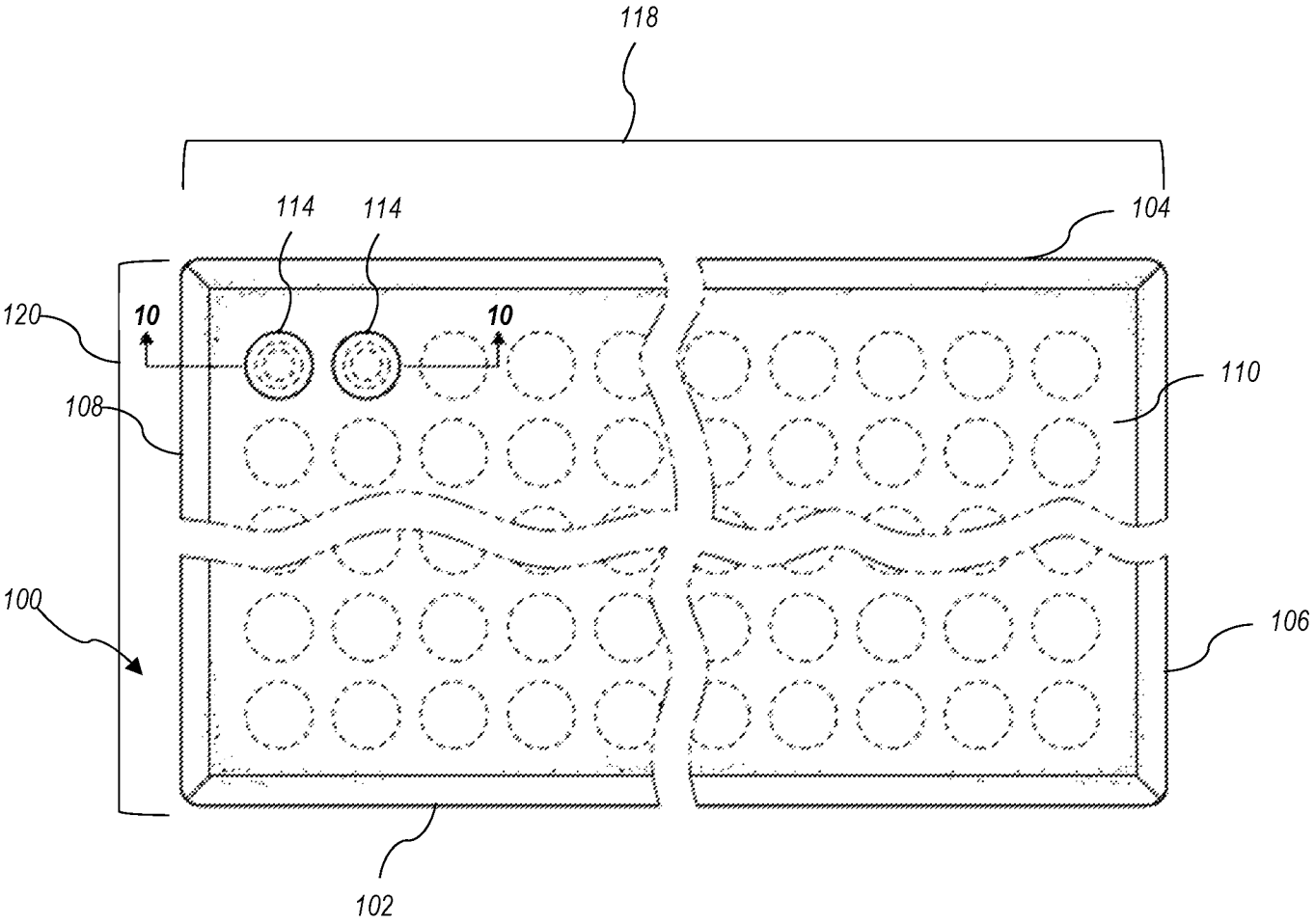
FIG. 6 is a top view of the insert block of FIG. 5.

Attention will now be directed to FIGS. 6-10 which illustrate various views of the insert block 100. For example, FIG. 6 shows a top view of the insert block 100 of FIG. 5. Insert block 100 is shown having a length 118 (e.g., the length of front side 102 and back side 104) and a width 120 (e.g., width of first lateral side 106 and second lateral side 108). The length and width of the insert block 100 determine the number of cartridge pockets which can be reamed inside the insert block 100. For example, cartridges come in calibers which range from approximately 4 mm in diameter to approximately 13 mm in diameter. A common caliber is a 9 mm diameter. Thus, in order to accommodate a grid size of 5×10 of cartridge pockets which are configured to house 9 mm cartridges, as illustrated in FIG. 6, the width 120 may be greater than 45 mm and the length may be greater than 90 mm, in order to allow for spacing between the cartridge pockets 114 as well as spacing between the outermost cartridge pockets and the outer perimeter edges of the insert block 100.

Figure 7:
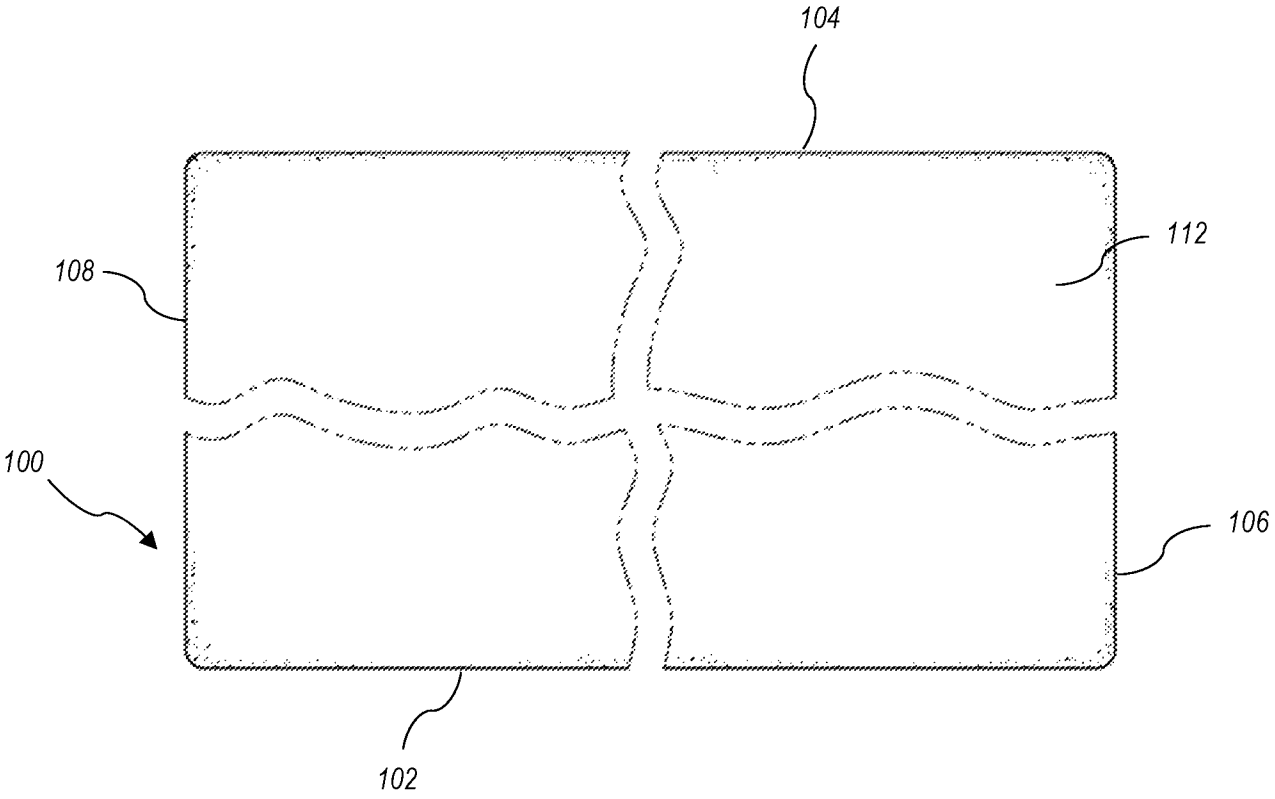
FIG. 7 is a bottom view of the insert block of FIG. 5.

Attention will now be directed to FIG. 7, which is a bottom view of the insert block 100 of FIG. 5. FIG. 7 illustrates a birds-eye view of the bottom 112 of insert block 100. The bottom 112 is shown as having a smooth, flat surface, such that the bottom 112 is configured to be flush with a smooth flat inner surface of the cavity 406 of the bottom insert 404.

Figure 9:
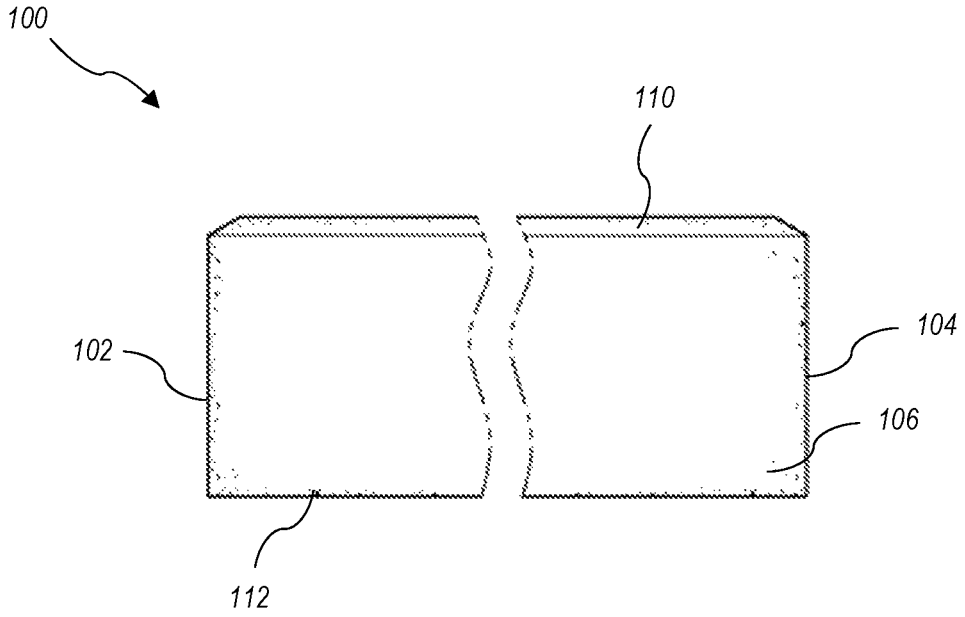
FIG. 9 is a first side view of the insert block of FIG. 5. (The second side view, which is an opposing side view to the first side view, is identical).

Attention will now be directed to FIG. 9, which is a first side view of the insert block 100 of FIG. 5. (The second side view, which is an opposing side view to the first side view, may be identical). As shown in FIG. 9, the first lateral side 106 comprises the same height as the front side 102 and back side 104 and the same width as second lateral side 108.

Figure 8:
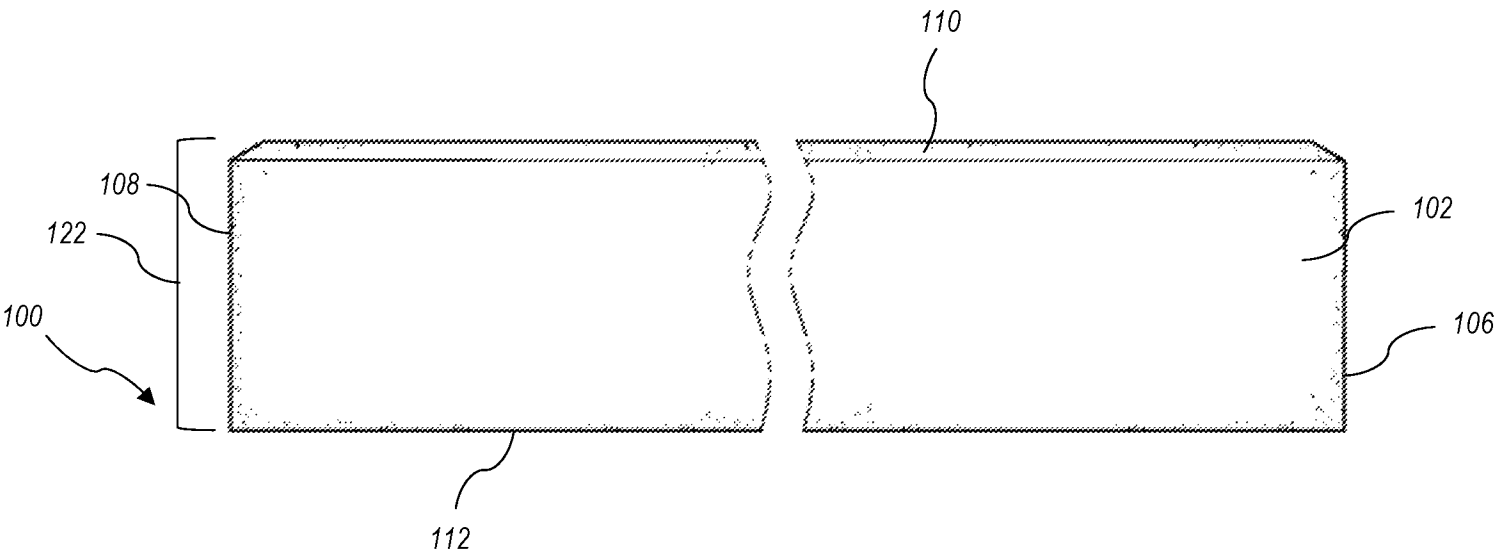
FIG. 8 is a front view of the insert block of FIG. 5. (The rear view is identical).
Figure 10:
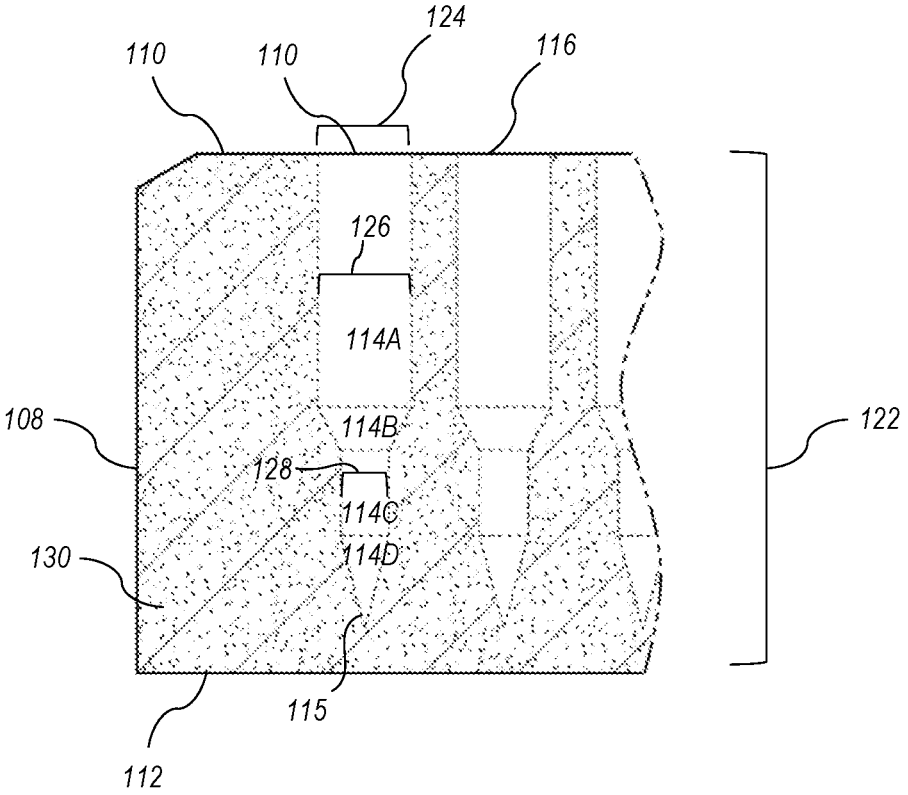
FIG. 10 is a cross-sectional view through the insert block of FIG. 5, taken along line 10-10 of FIG. 6.

Attention will now be directed to FIGS. 8 and 10, which show a front view and a cross-sectional view of the same insert block 100, respectively. FIG. 8 illustrates insert block 100 having a height 122 which determines a thickness of the insert block 100. The height 122 is configured such that a cartridge pocket is able to house a desired portion of the height of a cartridge. In an embodiment, less than the entire cartridge height is housed in the cartridge pocket, leaving a portion of the cartridge height to project above the insert block, to facilitate easier gripping and removal of the cartridge. Any such projecting portion (e.g., the base of the cartridge) may be received into another cartridge pocket formed into the lid insert or a lid insert block, as will be described in another embodiment, hereafter.

The length of cartridges (or rounds, which includes the shell casing and the bullet) is measured from the base of the shell casing to the tip of the bullet, which is seated into the shell casing. Cartridges typically range in height from approximately 0.4 inches to approximately 2.5 inches. Thus, the height or thickness 122 of the insert block 100 accommodates the depth of the cartridge pocket (e.g., cartridge pocket depth 130) plus spacing between the bottom tip of the cartridge pocket (e.g., tip 115) and the bottom 112 of the insert block 100. Thus, the height 122 of the insert block 100 may comprise heights corresponding to any height up to total height of the cartridge, such that a portion of the cartridge (e.g., the base portion) is protruding from the opening of the cartridge pocket (e.g., the cartridge pocket is configured to house a portion such as a majority of the cartridge). Alternatively, the height of the insert block 122 may comprise heights which are greater than a height of the cartridge, e.g., such that a base portion of the cartridge is flush with the top 110 of the insert block 100 when housed inside the cartridge pocket (e.g., the cartridge pocket is configured to house the entire cartridge from base to tip). Even where the cartridge height may not require it, the thickness 122 of the insert block 100 may be greater, e.g., to simply fill the space within the carrying case. In an embodiment, the insert may have a height of up to 6 inches (e.g., typically 2-6 inches).

Attention will now be directed more particularly to FIG. 10, which is a cross-sectional view through the insert block 100 of FIG. 5, taken along line 10-10 of FIG. 6. For example, FIG. 10 shows a portion of insert block 100, including second lateral side 108, top 110, and bottom 112. The portion is shown having a plurality of cartridge pockets 114. Each cartridge pocket comprises a height 130 which extends from the tip 115 to the opening 124 at the top 110 of the insert block 100. The opening 124 comprises a width 126, which is the same as the width of the first tier (e.g., tier 114A) of the cartridge pocket. As shown, a base portion 502*a* of the cartridge 502 may protrude from the opening 124. The cartridge pockets beneficially allow for a portion (non-tips/bases) of the cartridges to extend vertically past the top 110 of the insert block 100, wherein users are able to easily pick up individual cartridges with their fingers in order to load a magazine of a firearm.

Figure 10A:
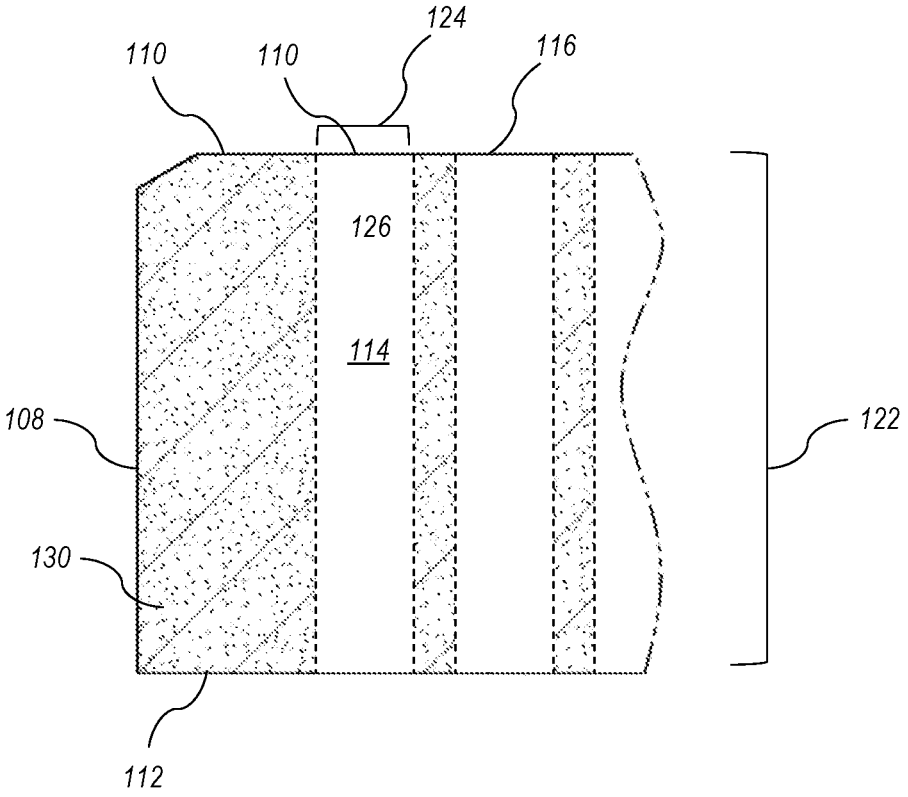
FIG. 10A is a cross-sectional view through an alternative insert block similar to that shown in FIG. 10.

Each cartridge pocket is reamed or cut out from the insert block in order to removably secure a particular cartridge having a certain shape and caliber. For example, some cartridges house bullets where the cartridge has different diameters along its height. As shown in FIG. 10, the cartridge pocket 114 is reamed according to the different diameters (e.g., tier 114A, tier 114B, tier 114C, and tier 114D). Tier 114A is a uniform cylindrical shape, while tier 114B is a tapered tier which goes from width 126 to width 128. Tier 114C is a uniform cylindrical shape, similar to tier 114A, but with a smaller diameter. Finally, tier 114D tapers from width 128 to tip 115. It will be appreciated that in embodiments where the distal end is not closed (but is open), tier 114D may not be present. FIG. 10A illustrates such an embodiment. It should be appreciated that the cartridge pocket may comprise any combination of diameters and/or shapes along its heights in order to accommodate the different cartridges based on bullet type and caliber. In an embodiment, the pocket can be reamed with the same reamer or mandrel (or same size thereof) used to form the bore of the rifle or other firearm, providing an exact fit for the cartridge, in pocket 114.

Furthermore, insert block 100 is shown having a certain material density. The density of such a foam material is configurable based on the material type and according to the specifications required for impact/force protection and/or shock absorption. In some embodiments, the insert block 100 comprises a foam material. Some foam materials include high-density foam which offers high shock absorption, a closed-cell foam which does not absorb water. In an embodiment, the foam may comprise polyurethane. Closed-cell foam is characterized by its high tensile strength, as well as its good shock insulating properties. In some embodiments, the insert block 100 comprises one or more other materials, such as aluminum, plastic, wood, composite, and/or a combination thereof.

Figure 11:
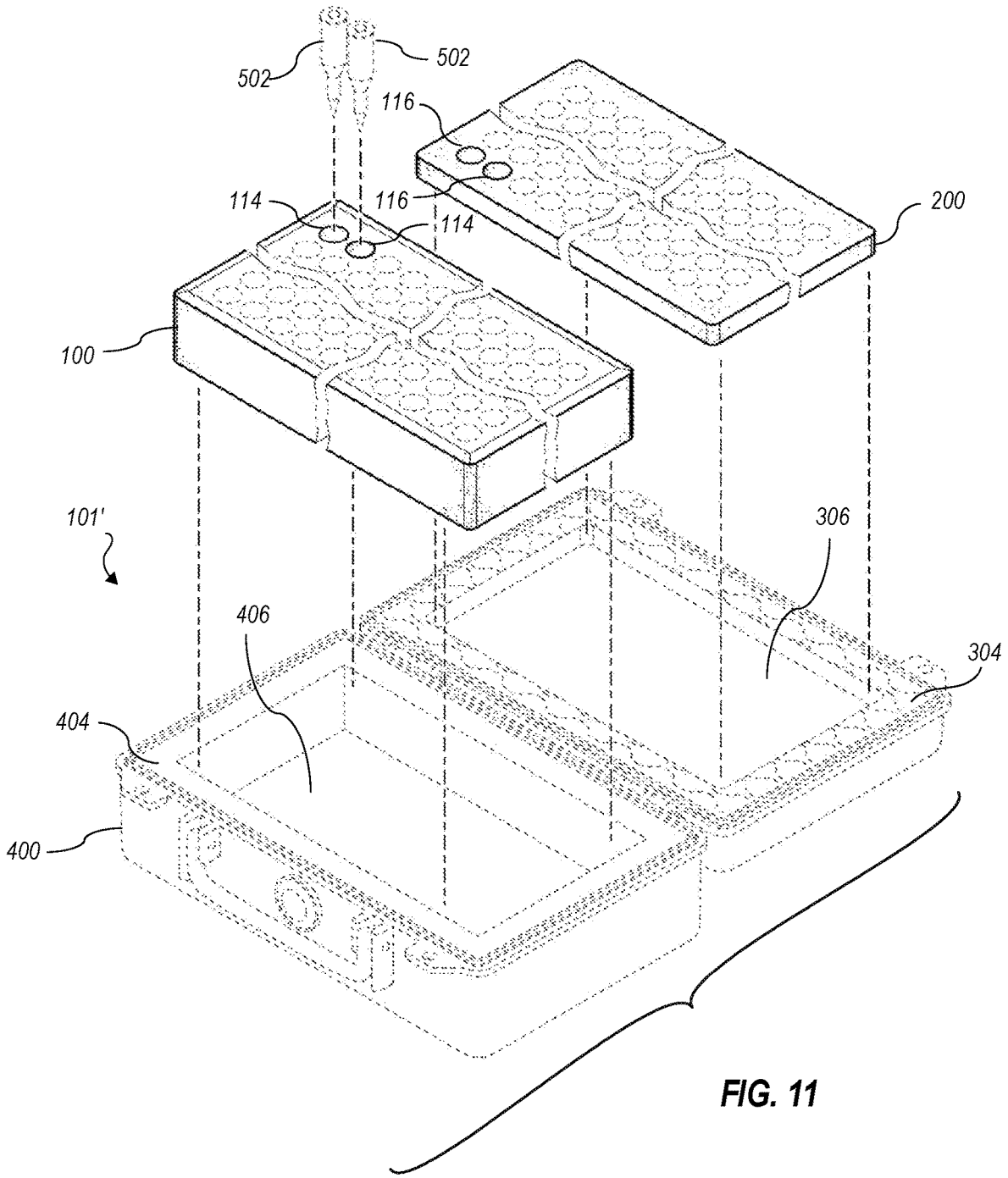
FIG. 11 is a top isometric exploded view of another ammunition box carrying case including insert blocks according to the present invention.

Attention will now be directed to FIGS. 11-20 which illustrate ammunition box carrying case 101' which is an alternate embodiment similar to ammunition box carrying case 101. For example, FIG. 11, is a top isometric exploded view of ammunition box carrying case 101' including an insert block 100, a lid insert block 200, outer case 400, and top or lid insert 304 (which is an alternate embodiment of top or lid insert 300) according to the present invention. As shown in FIG. 11, insert block 100 is configured to fit inside cavity 406 of bottom insert 404, as described previously. Similarly, lid insert block 200 is configured to fit inside cavity 306 of top insert 304. Similar to FIGS. 1-10, insert block 100 comprises a plurality of cartridge pockets 114 which are configured to house cartridges 502 Insert block 100 is configured to house a first portion (e.g., majority portion) of the cartridge. In contrast, lid insert block 200 acts as a supporting lid or cover to insert block 100, wherein the lid insert block 200 comprises a plurality of corresponding cartridge pockets 116 (e.g., top cartridge pockets 116 correspond to the underlying cartridge pockets 114). Cartridge pockets 116 are configured to house any protruding portion (e.g., a minority, base portion 502*a* of the cartridge 502).

Figure 12:
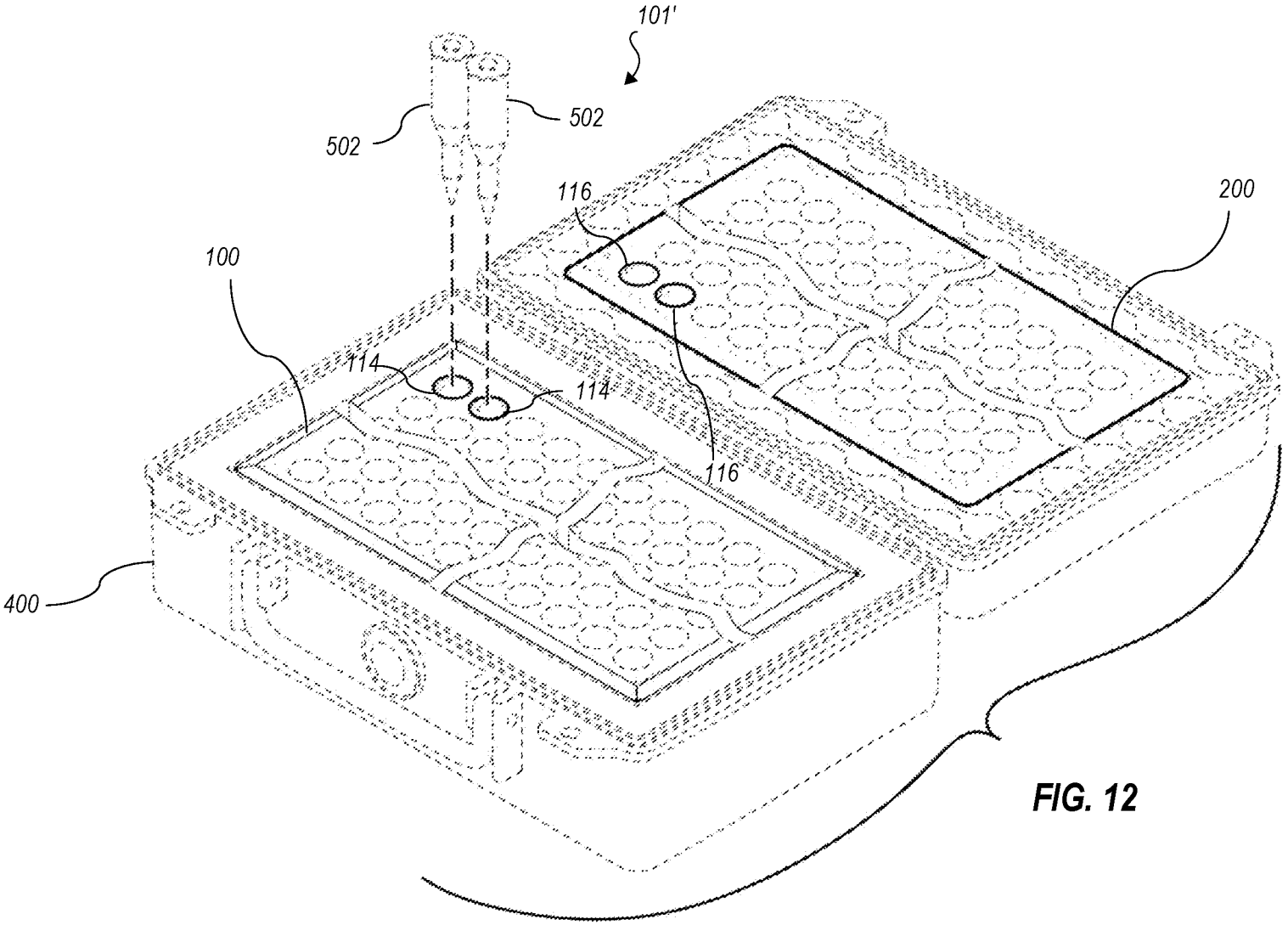
FIG. 12 is a top isometric partially exploded view of the ammunition box carrying case of FIG. 11.
Figure 13:
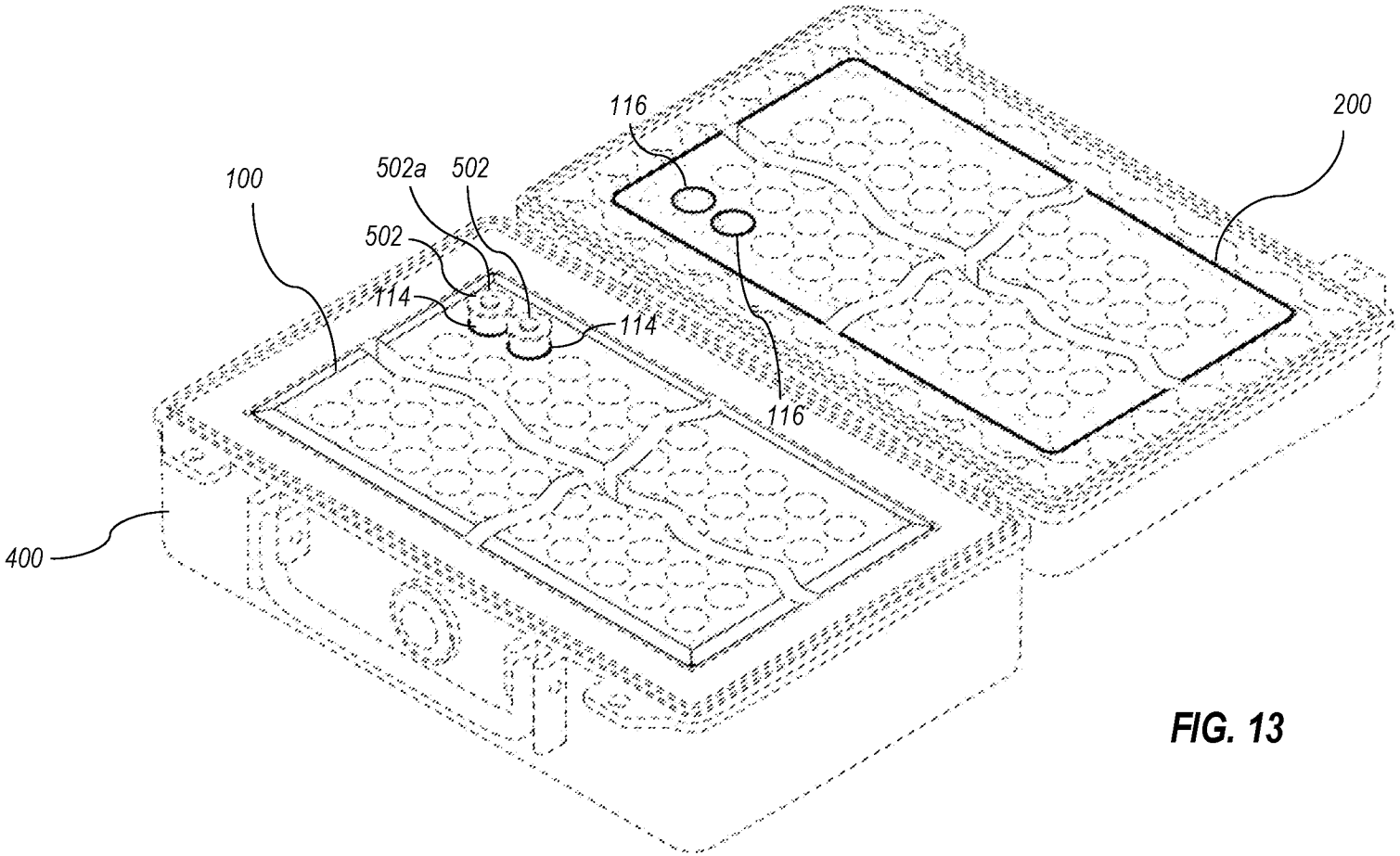
FIG. 13 is a top isometric unexploded view of the ammunition box carrying case of FIG. 11.
Figure 14:
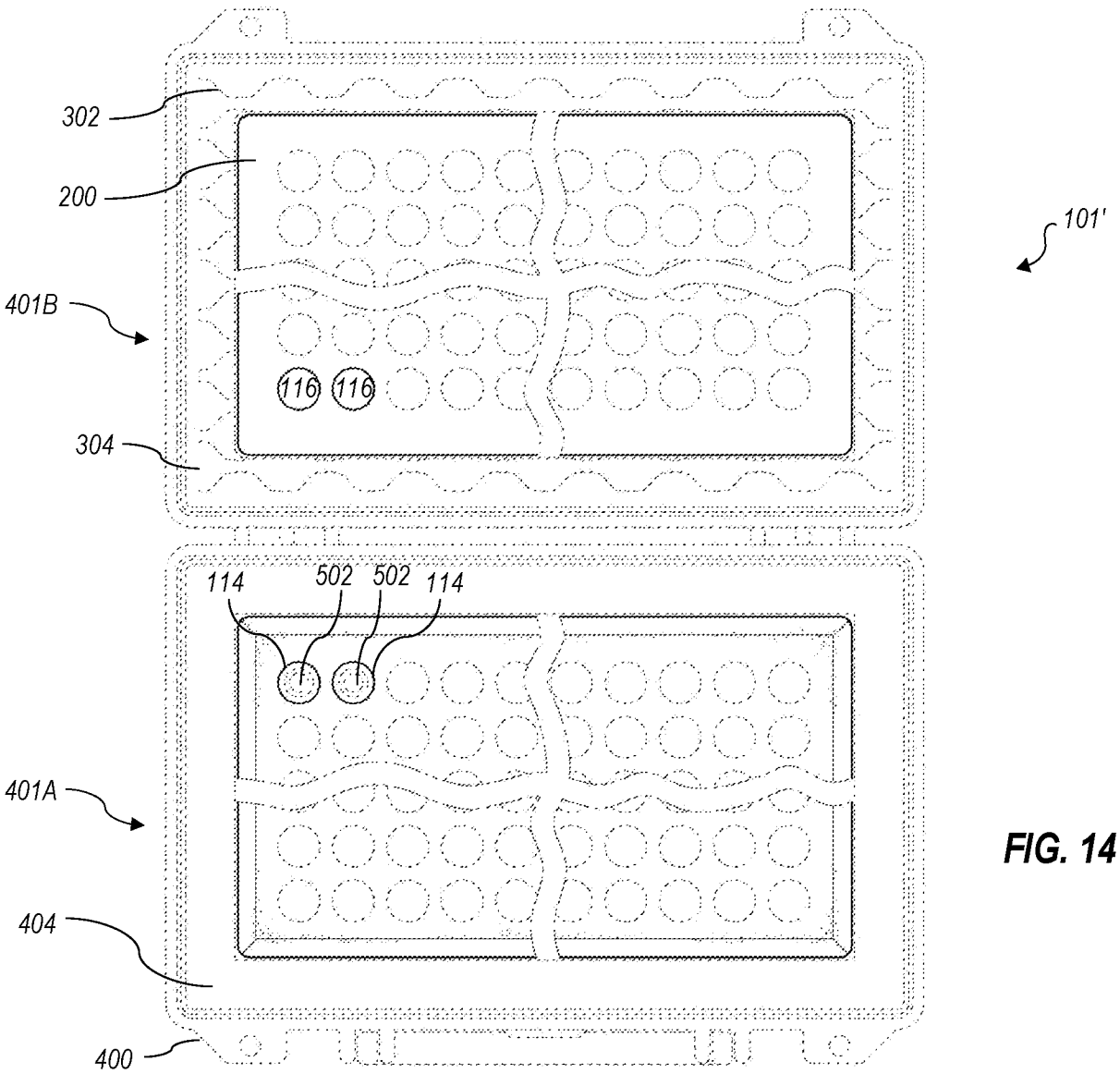
FIG. 14 is a top view of the opened ammunition box carrying case of FIG. 11.

Attention will now be directed to FIGS. 12-14, which show a top isometric partially exploded view, a top isometric unexploded view, and a top birds-eye unexploded view, respectively, of the ammunition box carrying case of FIG. 11. For example, FIG. 11 shows both the insert block 100 and lid insert block 200 fitted and removably secured within their respective cavities of inserts 404 and 304. Once the insert block 100 and lid insert block 200 are removably secured within the bottom portion and lid portion of the outer case 400, cartridges 502 may be loaded into and stored in the cartridge pockets 114 included in the insert block 100. Then, as the upper portion 401B of the outer case 400 is closed on top of the bottom portion 401A, the protruding base portions 502*a* of the cartridges 502 are received and cradled inside the top cartridge pockets 116. Referring to FIG. 14, which is a top view of the ammunition box carrying case of FIG. 11, the lid insert 304 may comprise an egg crate pattern 302. Alternatively, the surface presented by lid insert 304 may be planar, similar to as shown for bottom insert 404. Any desired surface pattern may be provided for either of such inserts. The lid insert 304 may comprise any shape and/or size of cavity in order to accommodate the corresponding lid insert block 200.

While FIG. 14 shows a plurality of cartridge pockets being identically sized and shaped, it should be appreciated that the insert block 100 (as illustrated in any one of FIGS. 1-14) may comprise different cartridge pockets of different diameters, depths, etc. so as to accommodate cartridges of different sizes or calibers. For example, each row or column could be configured to house a particular type/caliber of cartridge, or a percentage of cartridge pockets could be reamed for a particular cartridge while another percentage of cartridge pockets are reamed for a different cartridge. In such configurations, the lid insert block 200 is configured with lid cartridge pockets that correspond to the bottom cartridge pockets that are axially aligned with such pocket, when the lid is closed.

In one embodiment, all cartridge pockets in the insert block 100 are identical to one another. Another insert block 100 having identical length and width dimensions may also be provided, but with cartridge pockets that are differently sized or shaped, to allow different insert blocks to be provided, filled with different cartridges. Such a system may allow a user to have different insert blocks loaded with different caliber cartridges, allowing the user to remove a given insert block from the carrying case 101 or 101', and replace it with another desired insert block, filled with different caliber cartridges (or the same sized cartridges, once all cartridges of the first insert block have been used). For example, a sportsman may store such insert blocks in a gun safe, and easily take those insert blocks they desire, when going to a shooting range, swapping one insert block for another, within any given carrying case, because of the interchangeability of the insert blocks. The lid insert blocks 200 may also be interchanged, as needed.

Figure 15:
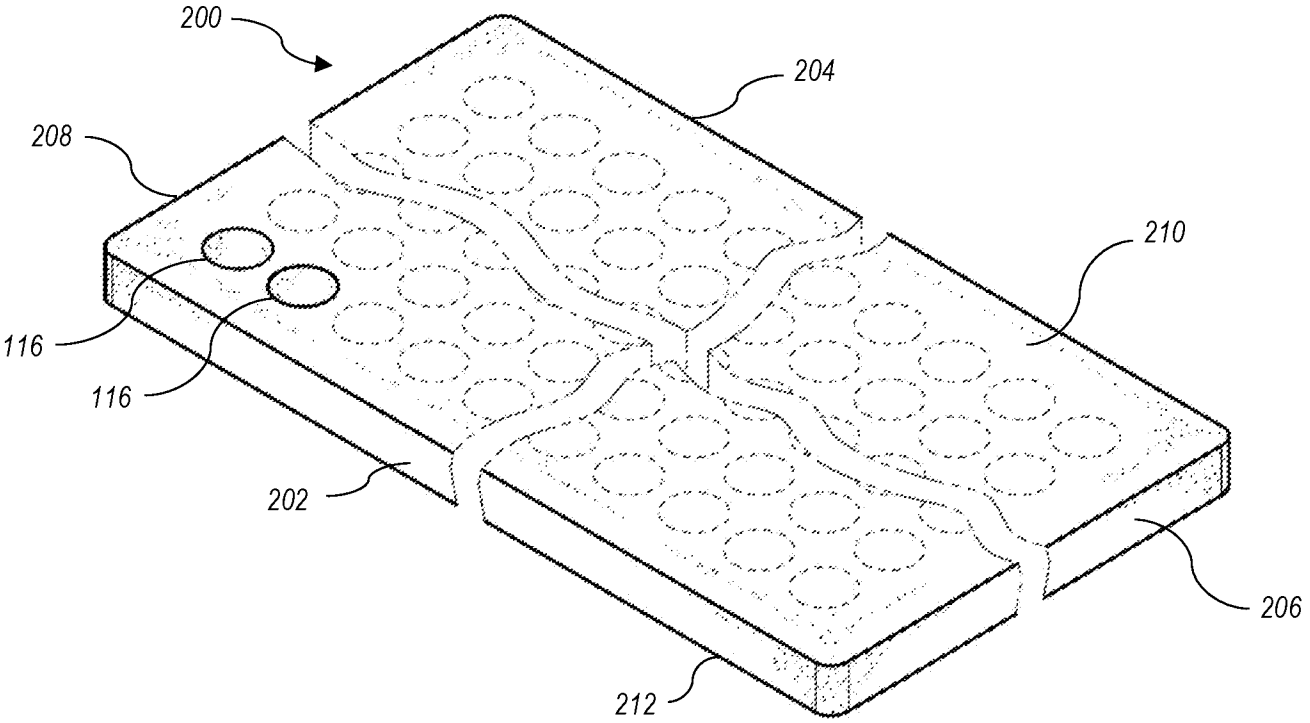
FIG. 15 is a top isometric view of the lid insert block received in the lid of the ammunition box carrying case of FIG. 12.
Figure 16:
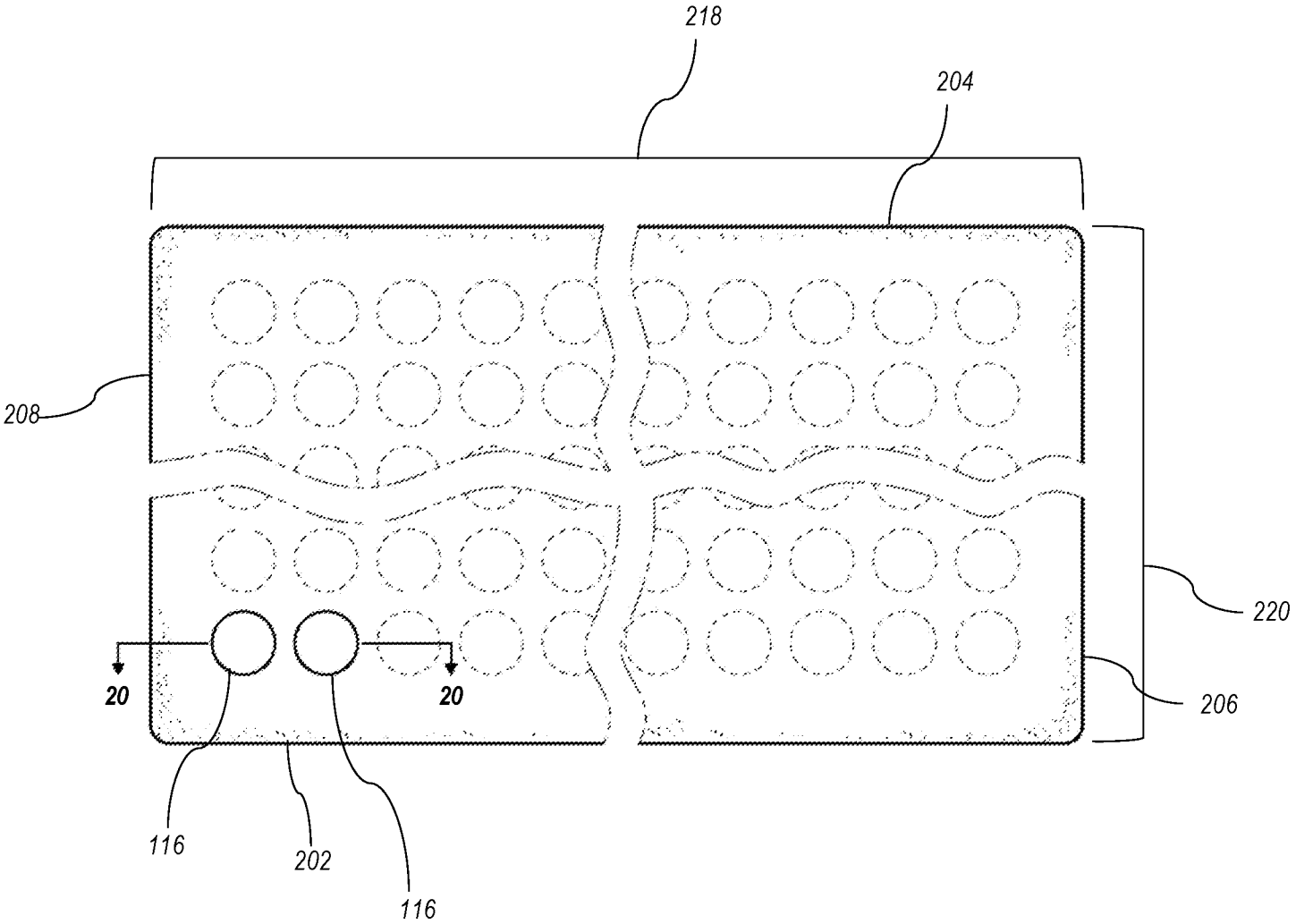
FIG. 16 is a top view of the lid insert block of FIG. 15.
Figure 17:
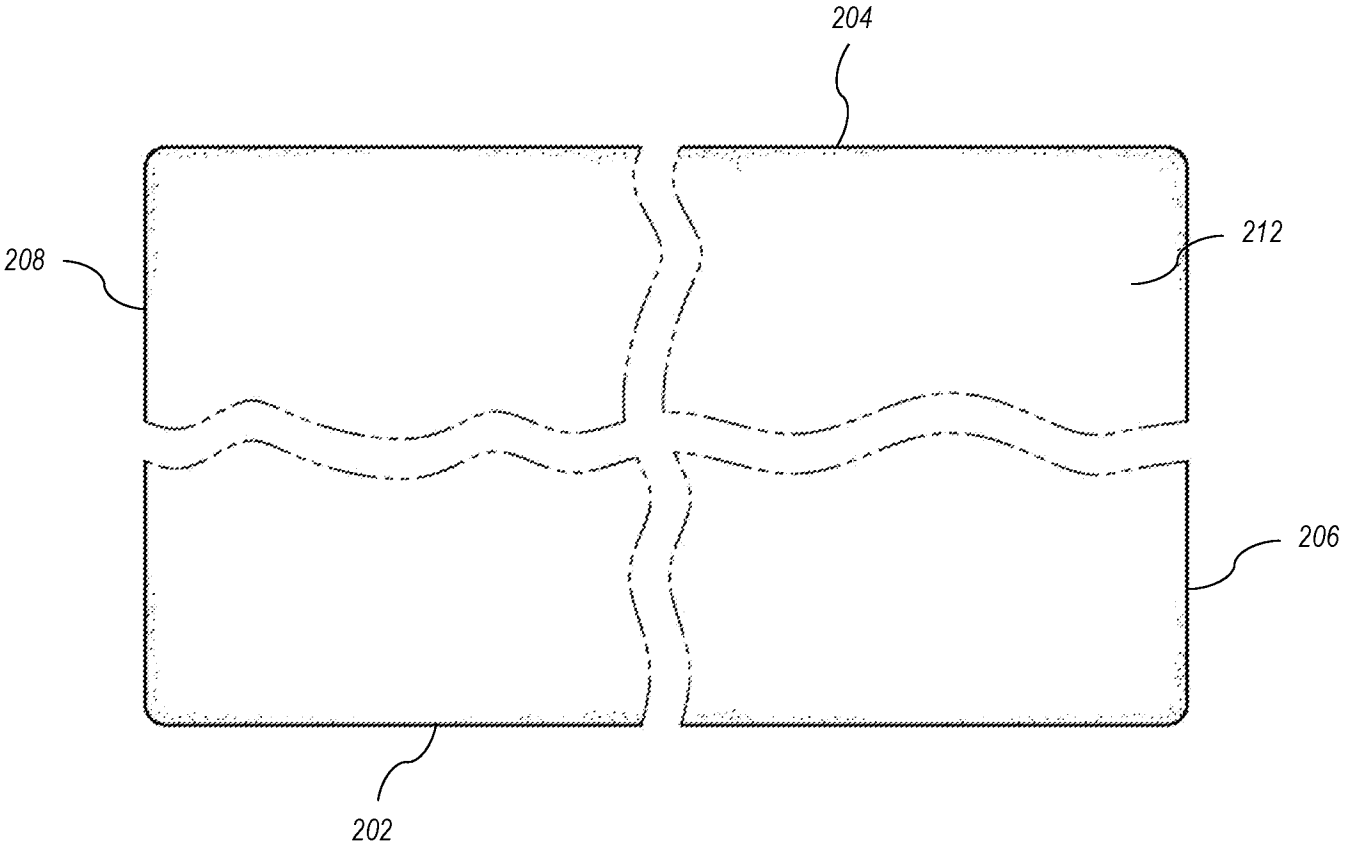
FIG. 17 is a bottom view of the lid insert block of FIG. 15.
Figure 18:
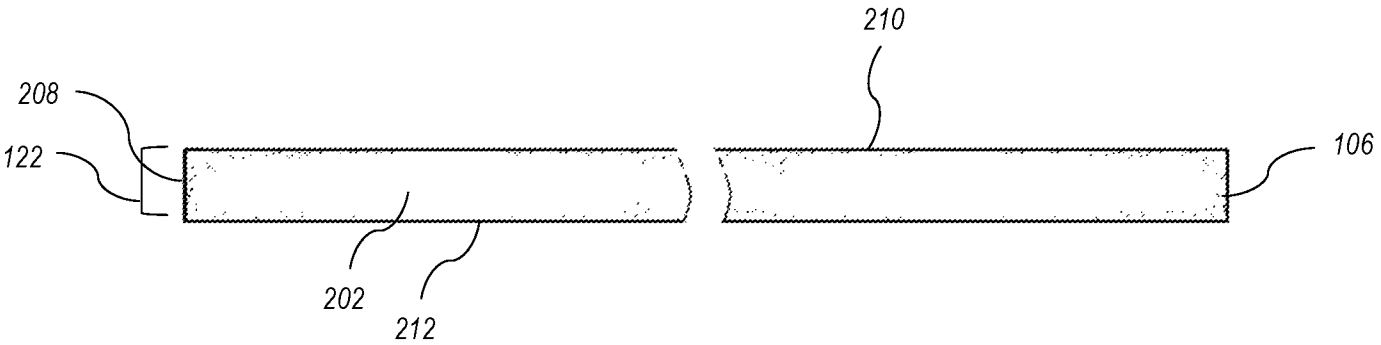
FIG. 18 is a front view of the lid insert block of FIG. 15. The rear view is identical.
Figure 19:
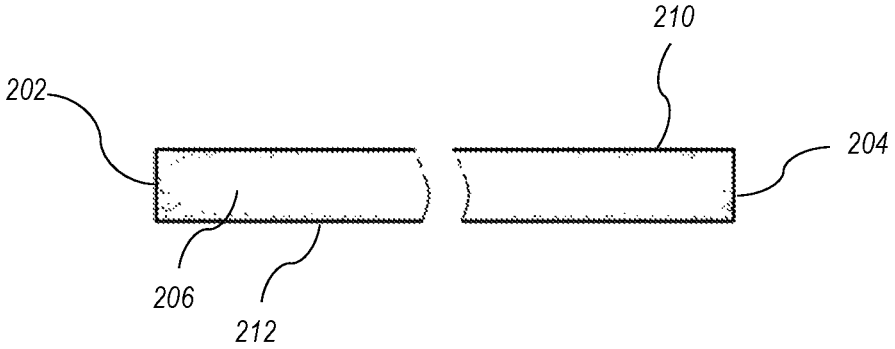
FIG. 19 is a first side view of the lid insert block of FIG. 15. The opposite side view is identical.

Attention will now be directed to FIGS. 15-20, which illustrate various views of the lid insert block 200. For example, FIG. 15 is a top isometric view of the insert block 200 received in the lid of the ammunition box carrying case of FIG. 12. FIG. 16 is a top view of the insert block of FIG. 15. FIG. 17 is a bottom view of the insert block of FIG. 15. FIG. 18, which is a front view of the insert block of FIG. 15. The rear view is identical. FIG. 19, which is a first side view of the insert block of FIG. 15. The opposite side view is identical.

In FIGS. 15-19, lid insert block 200 is shown having a front side 202, a back side 204, a first lateral side 206, a second lateral side 208, a bottom 210, and top 212. The lid insert block 200 further comprises a plurality of lid cartridge pockets 116. Additionally, the lid insert block 200 has a particular length 218, width 220, and height (thickness) 222. In some embodiments, the lid insert block 200 has the same length and width dimensions as the insert block 100, including the same number of cartridge pockets. However, in some embodiments, the height 222 of the lid insert block 200 is less than the height 122 of the insert block 100. In this manner, the bottom cartridge pockets included in the insert block 100, house the majority of the cartridge height, while the lid cartridge pockets included in the top insert block 200 may be significantly more shallow, housing only a small protruding portion of the cartridge.

In another embodiment, the lid insert block 200 could have a height which is equal or similar to the height of the insert block 100. In such embodiments, the insert block 100 could be configured to house a first set of cartridges, while the lid insert block 200 could be configured to house a second set of cartridges. The outer case 400 could have a thickness which allows for such stacked sets of cartridges.

Figure 20:
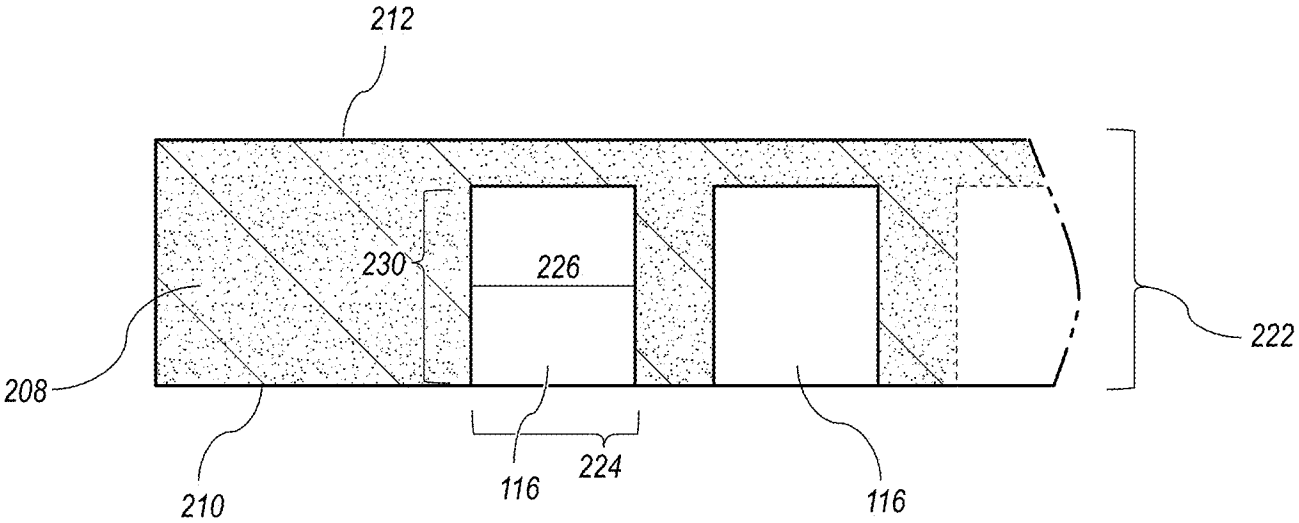
FIG. 20 is a cross-sectional view through the lid insert block of FIG. 15, taken along line 20-20 of FIG. 16.

Attention will now be directed to FIG. 20, which is a cross-sectional view through a portion of the insert block of FIG. 15, taken along line 20-20 of FIG. 16. FIG. 20 shows top insert block 200 having a height 222 which is greater than the top cartridge pocket height (depth) 230, such that there is spacing between the closed end of the cartridge pocket 116 and the top 212 of the top insert block 200. While pockets 116 are shown as closed before reaching the top 212 of block 200, it will be appreciated that in another embodiment, such pocket 116 could be open (i.e., a hole formed through the thickness of block 200). The pockets of the block such as shown in FIG. 10 could similarly alternatively be open at their distal end (i.e., a hole through the thickness of the insert block), as shown in FIG. 10A. Lid insert block 200 is shown having a plurality of lid cartridge pockets 116. For example, lid cartridge pocket 116 comprises a width 224 which is a uniform width throughout the height (depth) 230 of the lid cartridge pocket 116. The width 224 is also the width of the opening of the lid cartridge pocket 116, which opening is disposed on the bottom 210 of the lid insert block 200. This width 224 may also correspond to width 126 at opening 124 of the corresponding cartridge pocket 114, in insert block 100, positioned axially below. In some embodiments, as shown in FIG. 20, the width of cartridge pocket 116 is uniform throughout. Alternatively, the width may vary in tiers, similar to the bottom cartridge pockets illustrated in FIG. 10. The embodiment shown in FIG. 10A is open at the bottom distal end, and shown without internal tiers. The cartridge may simply be held within the pocket by a friction fit.

The lid insert block 200 is also shown having a particular material density. In some embodiments the material density of the lid insert block 200 is the same as the material density of the insert block 100. Alternatively, the material density of the lid insert block can be greater than or less than the material density of the bottom insert block 100. Additionally, in some embodiments, the material density of the insert blocks is the same as the material density of perimeter insert 304, 404, and/or lid insert 300. It should be appreciated that bottom perimeter insert 404, insert block 100, perimeter lid insert 304 (and/or lid insert 300), and lid insert block 200 may comprise any combination of materials and/or material density which facilitates the protection of cartridges from drops, moisture, and/or vibration during processing, storage, and transportation.

As described herein, the present invention is directed to a modular system for ammunition processing, storage, and transportation. The modular system comprises an outer carrying case (e.g., ammunition box) which is configured as a carrying case. A bottom portion of the outer case comprises a bottom insert which is configured with a cavity designed to removably secure an insert block. The insert block comprises a plurality of reamed cartridge pockets which are configured to store and removably secure a plurality of cartridges of a particular shape and caliber. The upper portion of the outer case may comprise either a uniform lid insert which is configured to cover the insert block or a perimeter lid insert 304 which comprises a cavity configured to receive a lid insert block. The lid insert block can include a plurality of lid cartridge pockets configured to cradle a portion of the cartridges that may protrude from the bottom insert block, when the carrying case is opened.

Each cartridge pocket is reamed with exact specifications that correspond to a particular cartridge type/caliber, such that the cartridges are substantially perfectly fitted inside the cartridge pocket. This provides for maximum protection against unwanted impact, moisture, and/or vibration during processing, storage, and transportation of the cartridges. This is an improvement over conventional ammunition boxes which do not provide such, but may allow for different or similar types/sizes of cartridges to rattle around therein during processing, storage, and transportation. Cartridges that are protected from these adverse conditions retain higher accuracy during firearm operation.

Furthermore, because the cartridges are easily accessible, the insert block is able to be used for manufacturing of cartridges, as well as reloading of ammunition in a firearm, thereby eliminating the need for a third-party reloading block. The ammunition carrying cases and even the insert blocks are easily stackable and can be labeled with the caliber of the cartridge pocket they are configured with. Furthermore, the system is modular, wherein users can have a single outer carrying case and switch out the insert block based on the caliber and type of bullet they wish to store/transport. Additionally, the insert block can be used standalone, without the outer carrying case, if desired.

Unless otherwise indicated, numbers expressing quantities, constituents, distances, or other measurements used in the specification and claims are to be understood as optionally being modified by the term "about" or its synonyms. When the terms "about," "approximately," "substantially," or the like are used in conjunction with a stated amount, value, or condition, it may be taken to mean an amount, value or condition that deviates by less than 20%, less than 10%, less than 5%, less than 1%, less than 0.1%, or less than 0.01% of the stated amount, value, or condition. As used herein, the term "between" includes any referenced endpoints. For example, "between 2 and 10" includes both 2 and 10.

Ranges between any values disclosed herein are contemplated and within the scope of the present disclosure (e.g., a range defined between any two values (including end points of a disclosed range) given as exemplary for any given parameter).

As used in this specification and the appended claims, the singular forms "a," "an" and "the" include plural referents unless the context clearly dictates otherwise.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A modular ammunition storage system comprising:

an insert block received into a carrying case, the insert block having a front side, a back side, a first lateral side, a second lateral side, a top surface, and a bottom surface, collectively forming a main body of the insert block that has a height, a length, and a width; and a plurality of cartridge pockets formed into the insert block, each cartridge pocket being open in the top surface of the insert block such that a distal end of each cartridge pocket may be closed above the bottom surface of the insert block and a proximal end of each cartridge pocket is open at the top surface of the insert block, wherein each cartridge pocket is configured to receive and removably secure a cartridge having a particular shape and caliber, wherein the insert block is selectively received and removably securable within an ammunition box insert within the carrying case, such that the ammunition box insert surrounds an outer perimeter of the insert block, which is received into the ammunition box insert such that the top surface of the insert block is flush with a top surface of the ammunition box insert.

2. The modular ammunition storage system of claim 1, wherein the insert block has a rectangular shape.

3. The modular ammunition storage system of claim 1, wherein the insert block includes approximately 10-200 cartridge pockets, or approximately 25-100 cartridge pockets, or approximately 50 cartridge pockets.

4. The modular ammunition storage system of claim 1, wherein the insert block has a height from about 0.3 inches to about 6 inches.

5. The modular ammunition storage system of claim 1, wherein the insert block has a width approximately from 4 inches to approximately 4 feet, or approximately 10 inches to approximately 3 feet, or approximately 10 inches to approximately 2 feet.

6. The modular ammunition storage system of claim 1, wherein the insert block has a length approximately from 4 inches to approximately 4 feet, or from approximately 10 inches to approximately 3 feet, or from approximately 10 inches to approximately 2 feet.

7. The modular ammunition storage system of claim 1, wherein each cartridge pocket is configured to receive and removably secure a majority of a height of the cartridge having the particular shape and caliber.

8. The modular ammunition storage system of claim 7, wherein a base of each cartridge received into the cartridge pocket extends out of the top of the top surface of the insert block, to facilitate gripping and removal of the cartridge received therein.

9. The modular ammunition storage system of claim 7, wherein the insert block is a bottom insert block, receivable into a bottom portion of the carrying case, the system further comprising a lid insert block that is receivable into a lid portion of the carrying case, wherein the lid insert block also includes cartridge pockets formed therein, a base portion of each cartridge that extends out the top of the top surface of the bottom insert block being received into a corresponding cartridge pocket of the lid insert block.

10. The modular ammunition storage system of claim 9, wherein the lid insert block is receivable and removably securable within a lid ammunition box insert disposed in a lid portion of the carrying case, the lid ammunition box insert surrounding a perimeter of the lid insert block.

11. A modular ammunition storage system comprising:

a first bottom insert block receivable into a bottom portion of a carrying case, the bottom insert block having a front side, a back side, a first lateral side, a second lateral side, a top surface, and a bottom surface, collectively forming a main body of the first bottom insert block that has a height, a length, and a width;

a first lid insert block associated with the first bottom insert block that is receivable into a lid portion of the carrying case, the first lid insert block having a front side, a back side, a first lateral side, a second lateral side, a top surface, and a bottom surface, collectively forming a main body of the first lid insert block that has a height, a length, and a width;

a second bottom insert block that is interchangeable with the first bottom insert block, so as to be interchangeably receivable into the bottom portion of the carrying case, the second bottom insert block having a front side, a back side, a first lateral side, a second lateral side, a top surface, and a bottom surface, collectively forming a main body of the second bottom insert block that has a height, a length, and a width; and a second lid insert block associated with the second bottom insert block that is receivable into a lid portion of the carrying case, the second lid insert block having a front side, a back side, a first lateral side, a second lateral side, a top surface, and a bottom surface, collectively forming a main body of the second lid insert block that has a height, a length, and a width;

each of the bottom and lid insert blocks including a plurality of cartridge pockets formed therein, each cartridge pocket of the bottom insert blocks being open in the respective top surface of the respective bottom insert block, such that a distal end of each cartridge pocket of the bottom insert blocks may be closed above the respective bottom surface of a given bottom insert block, and a proximal end of each cartridge pocket of the bottom insert blocks is open at the respective top surface of the respective bottom insert block, wherein each cartridge pocket of the bottom insert blocks is configured to receive and removably secure at least a portion of a cartridge having a particular shape and caliber, wherein each cartridge pocket of the lid insert blocks being open in the bottom surface of the lid insert blocks, such that a distal end of each cartridge pocket of the lid insert block may be closed above the top surface of the lid insert blocks and a proximal end of each cartridge pocket in the lid insert blocks is open at the respective bottom surface of the lid insert blocks, wherein each cartridge pocket of the lid insert blocks is configured to receive and removably secure at least a portion of a cartridge having a particular shape and caliber;

wherein each of the bottom insert blocks is selectively receivable and removably securable within a bottom ammunition box insert within the bottom portion of the carrying case, such that the bottom ammunition box insert surrounds an outer perimeter of one of the bottom insert blocks, when received into the bottom ammunition box insert;

wherein each of the bottom and lid insert blocks is selectively positionable in and removable from within the bottom portion or lid portion of the carrying case, to allow a user to select either the first bottom and lid insert blocks or the second bottom and lid insert blocks for positioning into the carrying case during use.

12. A modular ammunition storage system comprising:

a bottom insert block receivable into a bottom portion of a carrying case, the bottom insert block having a front side, a back side, a first lateral side, a second lateral side, a top surface, and a bottom surface, collectively forming a main body of the first insert block that has a height, a length, and a width;

a lid insert block that is receivable into a lid portion of the carrying case, the lid insert block having a front side, a back side, a first lateral side, a second lateral side, a top surface, and a bottom surface, collectively forming a main body of the lid insert block that has a height, a length, and a width; and each of the bottom and lid insert blocks including a plurality of cartridge pockets formed therein, each cartridge pocket of the bottom insert block being open in the top surface of the bottom insert block, such that a distal end of each cartridge pocket of the bottom insert block may be closed above the bottom surface of the bottom insert block and a proximal end of each cartridge pocket in the bottom insert block is open at the respective top surface of the bottom insert block, wherein each cartridge pocket of the bottom insert block is configured to receive and removably secure at least a portion of a cartridge having a particular shape and caliber, wherein each cartridge pocket of the lid insert block being open in the bottom surface of the lid insert block, such that a distal end of each cartridge pocket of the lid insert block may be closed above the top surface of the lid insert block and a proximal end of each cartridge pocket in the lid insert block is open at the respective bottom surface of the lid insert block, wherein each cartridge pocket of the lid insert block is configured to receive and removably secure at least a portion of a cartridge having a particular shape and caliber;

wherein a given cartridge is received into cartridge pockets of both the bottom insert block and the lid insert block, when the carrying case is closed, and wherein when the carrying case is opened, a base portion of the given cartridge is uncovered, no longer received into a corresponding cartridge pocket of the lid insert block, but a remaining portion of the given cartridge is still received in the cartridge pocket of the bottom insert block; and wherein the bottom insert block is receivable and removably securable from within a bottom ammunition box insert within the bottom portion of the carrying case, the bottom ammunition box insert surrounding a perimeter of the bottom insert block.

13. The modular ammunition storage system of claim 12, wherein the lid insert block is receivable and removably securable within a lid ammunition box insert disposed in a lid portion of the carrying case, the lid ammunition box insert surrounding a perimeter of the lid insert block.

14. A modular ammunition storage system comprising:

an outer carrying case comprising a bottom portion and a lid portion, the bottom portion being connected to the lid portion along a first side of the bottom portion and a first side of the lid portion such that the bottom portion and lid portion are closeable to form a hollow cavity inside the outer carrying case;

a bottom ammunition box insert disposed inside a perimeter, in the bottom portion of the outer carrying case comprising a bottom cavity;

a bottom insert block having a front side, a back side, a first lateral side, a second lateral side, a top surface, and a bottom surface forming a main body of the bottom insert block that has a height, a length, and a width; and a plurality of cartridge pockets disposed within the bottom insert block, such that a distal end of each cartridge pocket may be closed above the bottom surface and a proximal end of each cartridge pocket is open at the top surface of the bottom insert block, wherein each cartridge pocket is configured to receive and removably secure a cartridge having a particular shape and caliber;

wherein the bottom insert block is selectively receivable and removably securable within the bottom ammunition box insert, such that the bottom ammunition box insert surrounds an outer perimeter of the bottom insert block, which is received into the bottom ammunition box insert.

15. The modular ammunition storage system of claim 14, wherein the outer carrying case further comprises a locking mechanism configured to lock the bottom portion and lid portion together.

16. The modular ammunition storage system of claim 14, wherein the outer carrying case further comprises a carrying handle.

17. The modular ammunition storage system of claim 14, wherein the outer carrying case and/or the bottom insert block further comprises a label indicating a caliber of ammunition for which the modular ammunition storage system or bottom insert block thereof is configured.

18. The modular ammunition storage system of claim 14, further comprising:

a lid ammunition box insert disposed inside a perimeter, in the lid portion of the outer carrying case; and a lid insert block having a front side, a back side, a first lateral side, a second lateral side, a top surface, and a bottom surface, collectively forming a main body of the lid insert block that has a height, a length, and a width;

wherein the lid ammunition box insert comprises an interior cavity configured to receive and removably secure the lid insert block.

19. The modular ammunition storage system of claim 18, wherein the lid insert block also comprises a plurality of cartridge pockets, wherein each cartridge pocket of the bottom insert block corresponds to a cartridge pocket of the lid insert block, the corresponding cartridge pockets being axially aligned when the carrying case is closed.

20. The modular ammunition storage system of claim 19, wherein each cartridge pocket of the bottom insert block is configured to removably secure a majority portion of a cartridge.

21. The modular ammunition storage system of claim 20, wherein each cartridge pocket of the lid insert block is configured to removably secure a minority portion of the cartridge.

* * * * *